US006520257B2

(12) United States Patent
Allamon et al.

(10) Patent No.: US 6,520,257 B2
(45) Date of Patent: Feb. 18, 2003

(54) METHOD AND APPARATUS FOR SURGE REDUCTION

(75) Inventors: Jerry P. Allamon, 34 Naples La., Montgomery, TX (US) 77356; Jack E. Miller, Houston, TX (US)

(73) Assignees: Jerry P. Allamon, Montgomery, TX (US); Shirley C. Allamon, Montgomery, TX (US)

( * ) Notice: Subject to any disclaimer, the term of this patent is extended or adjusted under 35 U.S.C. 154(b) by 0 days.

(21) Appl. No.: 09/812,522

(22) Filed: Mar. 20, 2001

(65) Prior Publication Data

US 2002/0074128 A1 Jun. 20, 2002

Related U.S. Application Data

(60) Provisional application No. 60/255,481, filed on Dec. 14, 2000.

(51) Int. Cl.[7] ..... E21B 33/13

(52) U.S. Cl. ..... 166/291; 166/70; 166/177.4

(58) Field of Search ..... 166/285, 291, 166/70, 165, 177.4, 332.4, 324.4

(56) References Cited

U.S. PATENT DOCUMENTS

| | | | | |
|---|---|---|---|---|
| 2,196,652 | A | 4/1940 | Baker | 166/1 |
| 2,737,244 | A | 3/1956 | Baker et al. | 166/124 |
| 2,947,363 | A | 8/1960 | Sackett et al. | 166/224 |
| 3,039,531 | A | 6/1962 | Scott | 166/70 |
| 3,053,322 | A | 9/1962 | Kline | 166/184 |
| 3,054,415 | A | 9/1962 | Baker et al. | 137/68 |

(List continued on next page.)

FOREIGN PATENT DOCUMENTS

GB WO88/01678 10/1988 ..... E21B/33/16

OTHER PUBLICATIONS

Brown Oil Tools, Inc. General Catalog, 1962–1963, front cover and page 887, 2 pps.

Brown Oil Tools, Inc. General Catalog, 1966–1967, front and rear covers and pages 906–955, in particular, see p. 948 for "Combination Plug Dropping Head and Swivel", Brown Circulating Valve, "Centrury Set Shoes Types T, V&K" and "Orifice Float Collar," 52 pps.

Brown Oil Tools, Inc. General Catalog, 1970–1971, front and rear covers and pp. 806–875, in particular, see p. 852 for "Type C–1 "J" Setting Tool," "Type CS Setting Tool," "Heavy Duty Dropping Heat," and "Combination Plug Dropping Head and Swivel" and p. 854 for "Circulating Valve" and "Cementing Set Shoes, Type T, V, K&K Modified," 72 pps.

Brown Oil Tools, Inc. General Catalog, 1972–1973, front and rear covers and pp. 714–784, in particular, see pp. 762 and 763, 72 pps.

(List continued on next page.)

*Primary Examiner*—William Neuder
(74) *Attorney, Agent, or Firm*—Jackson Walker; Clarence E. Eriksen; Bryan P. Galloway

(57) ABSTRACT

Improvements are disclosed in surge reduction tools for running in casings or casing liners downhole with the ability to restore circulation in the event a tight hole condition is encountered. The improved tool includes among other features 1.) an axial indexing apparatus which allows the valving sleeve to be moved downward in predetermined increments to allow alternate closing and opening of the vent ports, 2.) a camming sleeve and Bellville spring washers which provide the surge reduction tool with a more predictable release pressure than has heretofore been available, 3.) a dart directing sleeve which has a smaller, smoother bore than the drill string and provides the important function of aligning the dart before it lands in the seat so that the dart resistance when passing through the seat is minimized, and 4.) chevron seals arranged in the housing above and below the vent port which reduces the potential for hydraulic lock and provides a seal mechanism that is more reliable while running in downhole conditions.

27 Claims, 16 Drawing Sheets

U.S. PATENT DOCUMENTS

| | | | | |
|---|---|---|---|---|
| 3,118,502 | A | 1/1964 | Cochran | 166/129 |
| 3,148,731 | A | 9/1964 | Holden | 166/184 |
| 3,376,935 | A | 4/1968 | Baker et al. | 166/224 |
| 3,403,729 | A | 10/1968 | Hickey | 166/75 |
| 3,713,490 | A | 1/1973 | Watson | 166/305 |
| 3,730,267 | A | 5/1973 | Scott | 166/0.5 |
| 3,955,624 | A | 5/1976 | Fredd et al. | 166/72 |
| 4,033,408 | A | 7/1977 | Fredd et al. | 166/75 R |
| 4,103,503 | A | 8/1978 | Smith | 61/97 |
| 4,132,243 | A | 1/1979 | Kuus | 137/268 |
| 4,252,196 | A | 2/1981 | Silberman et al. | 166/318 |
| 4,427,065 | A | 1/1984 | Watson | 166/250 |
| 4,435,872 | A | 3/1984 | Leikam | 15/104.06 A |
| 4,671,353 | A | 6/1987 | Daming | 166/70 |
| 4,893,678 | A | 1/1990 | Stokley et al. | 166/374 |
| 4,916,999 | A | 4/1990 | Palmer et al. | 89/1.815 |
| 5,181,569 | A | 1/1993 | McCoy et al. | 166/317 |
| 5,244,044 | A | 9/1993 | Henderson | 166/332 |
| 5,277,248 | A | 1/1994 | Breland | 166/70 |
| 5,290,128 | A | 3/1994 | Yeargain et al. | 405/209 |
| 5,293,933 | A | 3/1994 | Brisco | 166/70 |
| 5,388,930 | A | 2/1995 | McNease | 405/209 |
| 5,419,657 | A | 5/1995 | Davis | 405/209 |
| 5,421,408 | A | 6/1995 | Stoisits et al. | 166/274 |
| 5,443,122 | A | 8/1995 | Brisco | 166/285 |
| 5,499,687 | A | 3/1996 | Lee | 175/317 |
| 5,553,667 | A | 9/1996 | Budde et al. | 166/70 |
| 5,641,021 | A | 6/1997 | Murray et al. | 166/291 |
| 5,722,491 | A | 3/1998 | Sullaway et al. | 166/291 |
| 5,813,457 | A | 9/1998 | Giroux et al. | 166/153 |
| 5,960,881 | A | 10/1999 | Allamon et al. | 166/291 |
| 6,253,861 | B1 | 7/2001 | Carmichael et al. | 175/237 |

OTHER PUBLICATIONS

Brown Oil Tools, Inc. General Catalog, 1974–1975, front and rear covers and pp. 746–816, in particular, see pp. 792–793, 72 pps.

Brown Oil Toos, Inc. General Catalog, 1976–1977, front and rear covers and pp. 857–904, in particular, see pp. 900 and 902, 50 pps.

Brown Oil Tools, Inc. General Catalog, 1982–1983, front and cover and pp. 1410–1440, 32 pps.

Brown Oil Tools, Inc. General Catalog, 1986–1987, front cover and pp. 3052–3072, in particular see, pp. 3070–3071, 22 pps.

Baker Oil Tools, Inc. Catalog, 1962, front cover and pp. 461–466, 7 pps.

Baker Oil Tools, Inc. Catalog, 1966–67, front cover and pp. 502–504, 5 pps.

Baker Oil Tools, Inc. Catalog, 1970–71, front cover and pp. 580–596, 19 pps.

Baker Oil Tools, Inc. Catalog, 1972–73, front cover and pp. 356–376, 22 pps.

Baker Oil Tools, Inc. Catalog, 1974–75, front cover and pp. 324–348, 26 pps.

Baker Oil Tools, Inc. Catalog, 1976–77, front cover and pp. 396–418, 25 pps.

Baker Oil Tools, Inc. Catalog, 1982–83, front cover and pp. 662–680, 22 pps.

Baker Oil Tools, Inc. Product Guide, 1986–87, pp. 321, 336–337, 3 pps.

Baker Service Tools Mini Catalog, 1986–87, pp. 373–374, 2 pps.

Baker Oil Tools—Retrievable Packer Systems—Model "E"™ Hydro–Trip Pressure Sub Product No. 799–28, Specification Guide, pp. 53, 1 pp.

Lindsey Completion Systems General Catalog, 1986–87, frong cover and rear cover and pps. 4246–4275, in particular, pp. 4260 re "Cementing Equipment—Manifold", 32 pps.

Texas Iron Works Catalog, 1962–63, front cover and pp. 4902–4903, 3 pps.

Texas Iron Works Catalog, 1966–1967, front cover and pps. 4802–4803, 3 pps.

Texas Iron Works, Catalog, 1970–71, front cover and p. 4612, 2 pps.

Texas Iron Works, Catalog, 1972–73, front cover and p. 4430, 2 pps.

Texas Iron Works, Catalog, 1974–75, front and rear covers and pp. 4918–4955, in particular, pp. 4947 for "TIW Cementing Manifolds", 40 pp.

Texas Iron Works, Catalog, 1976–77, front cover and pp. 5544, 2 pps.

Texas Iron Works, Catalog, 1982–83, front and rear covers and pp. 7910–7951, in particular, pp. 7922 for "TIW Cementing Equipment", 44 pps.

Texas Iron Works, Catalog, 1986–87, front and rear covers and pp. 6090–6152, in particular, pp. 6106 for "Cementing Equipment", 64 pps.

TIW Liner Equipment, Mechanical–Set Liner Hangers Specifications, pp. 12 or 2838 (prior art), 1 pp.

TIW Marketing Application Drawing, 1724.01 Mech EJ–IB–TC RHJ Liner Hanger, Pin–up Class (prior art), 1 pp.

Davis Manual–Fill Float Shoes, pp. 868–870 (prior art), 3 pps.

Davis Self–Filling Float Shoes and Float Collars, pp. 872–873, (prior art), 2 pps.

Ray Oil Tool Company Introduces, Another Successful Tool: Intercasing Centralizers (Inline Centralizers), Lafayette, Louisiana (prior art), 7 pps.

TIW, Liner Equipment, Hydro–Hanger specifications pp. 2837 and 1718.02 IB–TC R HYD HGR W/PIN TOP (prior art), 2 pps.

Weatherford Gemoco, ©Weatherford 1993, Model 1390 and 1490 Float Shoe Sure Seal Auto Fill, May 10, 1994, 8 pps. Note patent pending on last page.

TIW Corporation, Marketing application Drawing, 9758.05 Circulating Sub (prior art), 1 pp.

TIW Corporation, Marketing application Drawing, 1718.02 IB–TC R HYD HGR W/PIN TOP (prior art), 1 pp.

Downhole Products, The Spir–O Lizer™ (Patented), (Represented in North American by Turbeco Inc., 7030 Empire Drive, Houston, Texas 77040) (prior art), 7 pps.

SPE Drilling & Completion, Dec. 1996, Copyright 1996 Society of Petroleum Engineers, Zonal Isolation and Evaluation for Cemented Horizontal Liners, pp. 214–220; Turbeco, Inc. Spir–O–Lizer Products Job Log, 2 pps.; Downhole Products PLC Spir–O–Lizer Products Job Log, 8 pps. front and back; Spir–O–Lizer Technical Information and Price List, 1 pp.

Halliburton Services, RTTS Circulating Valve, 3 pps; RTTS Equipment, Operating Procedure (prior art), 2 pps.

TIW Liner Equipment, Setshoes, Type LA Setshoe; Type LA–2 Setshoe; Type CLS–2 Setshoe; and Type CD–2 Setshoe, pp. 23, (prior art), 1 pp.

TIW Corporation, Marketing application Drawing, 1904.01 Fillup Setshoe (prior art), 1 pps.

TIW Liner Equipment, Liner Float Equipment, C–FL Lading Collar; Regular Landing Collar; HS–SR Landing Collar with Ball–and Seat Shear Assembly; and C Float Collar, pp. 22 (prior art), 1 pp.

TIW Corporation, Marketing application Drawing, 1816.01 PDC L Landing Collar W/Anti–Rotation Clutch (prior art), 1 pp.

Davis Cementing Enhancement Devices, Davis Non–Welded Semi–Rigid Centralizer (SRC); Davis Non– Welded Rigid Centralizer; and Centralizer Comparison Chart, p. 886 (prior art), 1 pp.

Varco, B.J. Drilling System Reference Drawing Sheets, TDS–6S Block Dolly; TDS–6S Guide Dolly; and Crank Assy Installation (prior art), 6 pps.

A Model "E" "Hydro–Trip Pressure Sub" No. 799–28, distributed by Baker Oiul Tool, a Baker Hughes Company of Houston, Texas, is installable on a string below a hydraulically actuated tool, such as a hydrostatic packer to provide a method of applying the tubing pressure required to actuate the tool. To set a hydrostatic packer, a ball is circulated through the tubing and packer to the seat in the "Hydro–Trip Pressure Sub", and sufficient tubing pressure is applied to actuate the setting mechanism in the packer. After the packer is set, a pressure increase to approximately 2,500 psi (17, 23MPa) shears screws to allow the ball seat to move down until fingers snap back into a groove. The sub then has a full opening, and the ball passes on down the tubing, as discussed in the Background of the Invention of the present application. (See "CI" above).

No. 0758.05 sliding sleeve circulating sub of fluid bypass manufactured by TIW Corporation of Houston, Texas (713)729–2110 used in combination with an open (no float) guide shoe, as discussed in the Background of the Invention of the present application. (See "DJ" above).

Halliburton RTTS circulating valve, distributed by Halliburton Services. The RTTS circulating valve touches on the bottom to be moved to the closed port position, i.e. the J–slot sleeve needs to have weight relieved to allow the lug mandrel to move. The maximum casing liner weight that is permitted to be run below the Halliburton RTTS bypass is a function of the total yield strength of all the lugs in the RTTS bypass which are believed to be significantly less than the rating of the drill string, as discussed in the Background of the Invention of the present application. (See "DN" above).

A Primer of Oilwell Drilling by Ron Baker, Published by Petroleum Extension Service, The University of Texas at Austin, Austin, Texas in cooperation with International Association of Drilling Contractors, Houston, Texas 1979, cover page and pp. 56–64, 10 pps.

Schlumberger Dowell Brochure—Don't let cementing in deepwater put your well at risk, 5 pps.

Connect Schlumberger Homepage, connect Schlumberger Log–in, Jul. 23, 1997, 2 pps. Schlumberger Limited, Welcome to Schlumberger, 2 pps. Search the Schlumberger Server, 1 pp. Excite for Web Servers Search Results, Jul. 23, 1997, 4 pps. Excite for Web Servers Search Results, Jul. 24, 1997, 4 pps.

"DeepSea EXPRES*"—Dowell developed the EXPRES concept of preloading casing wiper plugs inside a basket several years ago. Expanding this approach to subsea cementing greatly simplifies plug design. By also utilizing three darts and three plugs rather than a ball, a system had been devised that provides: Enhanced reliability, Improved jog quality, Reduced rig time Jul. 23, 1997, 1 pp.

DeepSea EXPRES—Surface Dart Launcher (SDL), Jul. 23, 1997, 2 pps.

DeepSea EXPRES—SubSea Tool (SST), Jul. 24, 1997, 2 pps.

SCR Patents 1987–1996—Schlumberger Cambridge Research by Author, Jul. 24, 1997, 8 pps.

METHOD AND APPARATUS FOR SURGE REDUCTION

CROSS-REFERENCE TO RELATED APPLICATIONS

The present application claims the benefit of the filing date of Provisional application Ser. No. 60/255,481 filed Dec. 14, 2000.

BACKGROUND OF THE INVENTION

1. Field of the Invention

The present invention relates to a method and apparatus for use in the oil industry, and, more particularly, to a method and apparatus for providing surge reduction functionality while running a casing liner downhole.

2. Description of the Prior Art

The principle of operation of a surge reduction tool is described in U.S. Pat. No. 5,960,881 ("the '881 patent"), which is incorporated herein by reference and which should be referred to with respect to the advantages provided by that invention. In practice, the invention of the '881 patent has provided the oilwell industry with the long-desired capability of running in casing liners faster and more reliably with a minimum of lost drilling mud.

While the device of the '881 patent provided for the first time a mechanism for reducing surge pressure, circumstances may be encountered during the running downhole of a casing liner where even a tool in accordance with the '881 patent may be rendered ineffective to reduce surge pressure. Specifically, if a casing liner encounters a tight hole condition or bridge while being lowered into the wellbore, it is not possible to effectively circulate mud around the end of the casing liner to help free it. This is because the surge pressure reduction flow ports of the apparatus in accordance with the '881 patent are open to the annulus and will short-circuit flow to the annulus above the casing liner. If this happens, the driller may establish circulation by dropping the drop ball before reaching the target depth to close the open ports of the surge reduction tool. The driller may then use the mud pumps to clean up and wash out the borehole. Once the driller makes this decision, however, he must attempt to lower the casing liner to the target depth without further benefits of surge reduction, since the tool can only be functioned once.

Accordingly, the oil industry would find desirable a surge reduction tool that allows an additional sequence of opening and closing of the flow ports to provide alternation between the "surge reduction" and the "circulation" modes of operation. In other words, a tool would be desirable which provides surge reduction, which allows for circulation to be established in the event the casing encounters tight hole conditions, and which provides surge reduction after the borehole conditions are improved.

The oil industry has seen other devices that claim to regulate communication between the wellbore annulus and the well fluid; however, none of these devices provides surge reduction functionality. U.S. Pat. No. 3,457,994, assigned on its face to Schlumberger Technology Corp., discloses a well packer apparatus with a pressure-powered valve and locking latch device which can be initially set between open and closed conditions and lowered into a wellbore on a running-in string. However, the pressure-powered valve is opened and closed by an actuator, not indexed by a drop ball. In addition, the stated purpose of the '944 device is to regulate the passage and removal of the commodity within the well, not to facilitate surge reduction of a downhole tool.

U.S. Pat. No. 3,517,743, assigned on its face to Dresser Industries, Inc., provides a selective interval packer device which permits fluid to pass through a seated ball valve during descent into a wellbore and which aligns with a selectively indexed location along the wellbore. However, the stated purpose of the device is to isolate and communicate with formations at selected intervals. The opening of the ball valve to permit fluid flow through the packer device and the indexed regions along the wellbore facilitate this purpose and do not provide a means to reduce surge pressure during the running of casings.

U.S. Pat. No. 5,730,222 ("the '222 patent"), assigned on its face to Dowell, provides a downhole circulating sub device to direct or divert fluid flow between a measurement while drilling (MWD) tool and a flow activated motor and drill bit. The sub device is connected between the upper MWD tool and the lower drill bit, and may be activated and deactivated by a respectively pushing or pulling on a coiled tube. When activated, the sub device directs flow to the flow activated motor and drill bit. Once deactivated, the sub device short-circuits the drill, but still allows for flow through the MWD tool (the '222 patent, FIGS. 1 and 2). However, device of the '222 patent is manipulated by physically pushing or pulling on a coil tube and not by a dropping a ball through drill string and into apparatus to open or close the flow ports. Furthermore, the stated purpose of the device of the '222 patent is to direct fluid flow into or divert fluid flow from a downhole flow activated tool, and not to implement surge pressure reduction.

Subsequent to the invention of the '881 patent, others have attempted to produce apparatus which provides surge reduction. Baker Hughes began to offer apparatus which functions in accordance with the '881 patent. Also, in U.S. Pat. No. 6,082,459 ("the '459 patent"), assigned on its face to Halliburton, a diverter apparatus is disclosed for reducing surge pressure while running a casing liner in a partially cased well bore. Halliburton is believed to market this device as the "SuperFill" system. According to the '459 patent and Halliburton's literature, the SuperFill system is movable from a closed port position to an open port position and vice versa.

The diverter device shown in FIG. 3B of the '459 patent comprises an inner tubular housing, an outer sliding sleeve, and a system of drag springs arranged outside and surrounding the sliding sleeve. In operation, the diverter is run downhole where the springs directly engage a previously cemented casing liner. As the springs engage the casing liner, the drag springs compress and drag the outer sliding sleeve relatively upwards with respect to the inner housing into an open port position. To move the apparatus from the open to the closed position, the '459 patent states that downward movement is stopped and an upward pull is applied so that the tubular housing moves upwardly until the sliding sleeve covers the flow ports in the inner tubular housing. According to the '459 patent, the diverter apparatus includes a J-slot so that the diverter can be locked in the closed position by rotating the drill string.

In practice, it is believed that substantial problems may be encountered in use of the tool of the '459 patent. For example, one would not want to move the tool of the '459 patent from an open port position to a closed port position without also locking the tool in the closed port position. This is because the weight of the casing liner may cause the tool to trip to the open port position, if not locked. To lock the tool of the '459 patent, it is rotated to the right. This rotation also causes the running tool and casing liner to rotate. If the rotating casing liner gets caught in the borehole, the continued rotation can result in the running tool becoming disengaged from the casing liner. To avoid this disastrous result, the casing liner in practice is set on the bottom of the borehole before the diverter apparatus is locked in the closed position. This result is undesirable, since the casing liner cannot be properly cemented in place under these conditions.

A tool as described in the '881 patent includes a finger latching apparatus to latch the sliding valving sleeve apparatus into position. When the casing liner has reached target depth, a ball is pumped down the drill string until it lands in a yieldable seat that is contained within the latched valving sleeve. Once the ball has landed in the yieldable seat, pressure is increased until the pressure end load force overcomes the latched spring fingers and allows the valving sleeve to move into a lower position that closes the vent ports. The pressure is then increased further until the seat yields to an extent that allows the ball to pass through the seat and on down to the bottom of the borehole. In the embodiment of the invention of the '881, the release pressure can vary from tool to tool, because the release pressure is primarily controlled by the flexibility of the spring fingers and the friction between the spring fingers and the inner surface of the sleeve.

SUMMARY OF THE INVENTION

In accordance with the present invention, apparatus for reducing surge pressure while running a tubular in drilling fluid in a borehole is provided.

The apparatus of the present invention comprises a housing having a top and having a bottom end for connection to a casing hanger. The housing has at least one set of housing flow ports formed therein. The housing is suspended from the drill pipe, and the drill pipe provides a communication conduit between the drilling rig and the wellbore.

Apparatus in accordance with the present invention further comprises a sleeve within the housing, and the sleeve has at last two sets of sleeve flow ports which are located at different axial locations on the sleeve. Initially, the sleeve is positioned in the housing such that a first open port condition exists. Indexing apparatus is provided for axially moving the sleeve from the first open port position to a first closed port position, from the first closed port position to a second open port position, and from the second open port position to a second closed port position.

The indexing apparatus preferably includes a camming sleeve and spring washers which provide a tool in accordance with the present invention with a more predictable release pressure than has heretofore been available.

Another feature of the surge reduction tool of the present invention is a dart directing sleeve in the housing which has a smaller, smoother bore than the drill string and provides the important function of aligning the dart before it lands in the seat so that the dart resistance when passing through the seat is minimized.

Yet another feature of the improved tool of the present invention are chevron seals arranged in the housing above and below the vent port which reduces the potential for hydraulic lock and provides a seal mechanism that is more reliable while running in downhole conditions.

DESCRIPTION OF SPECIFIC EMBODIMENTS OF THE INVENTION

In oilfield applications, a "casing liner" and a "subsea casing string" are tubular members which are run on drill pipe. The term "casing liner" is usually used with respect to drilling operations on land, while the term "subsea casing string" is used with respect to offshore drilling operations. For ease of reference in this specification, the present invention is described with respect to a "casing liner." In the appended claims, the term "tubular member" is intended to embrace either a "casing liner" or a "subsea casing string."

A description of certain embodiments of the present invention is provided to facilitate an understanding of the invention. This description is intended to be illustrative and not limiting of the present invention.

Figure 13:
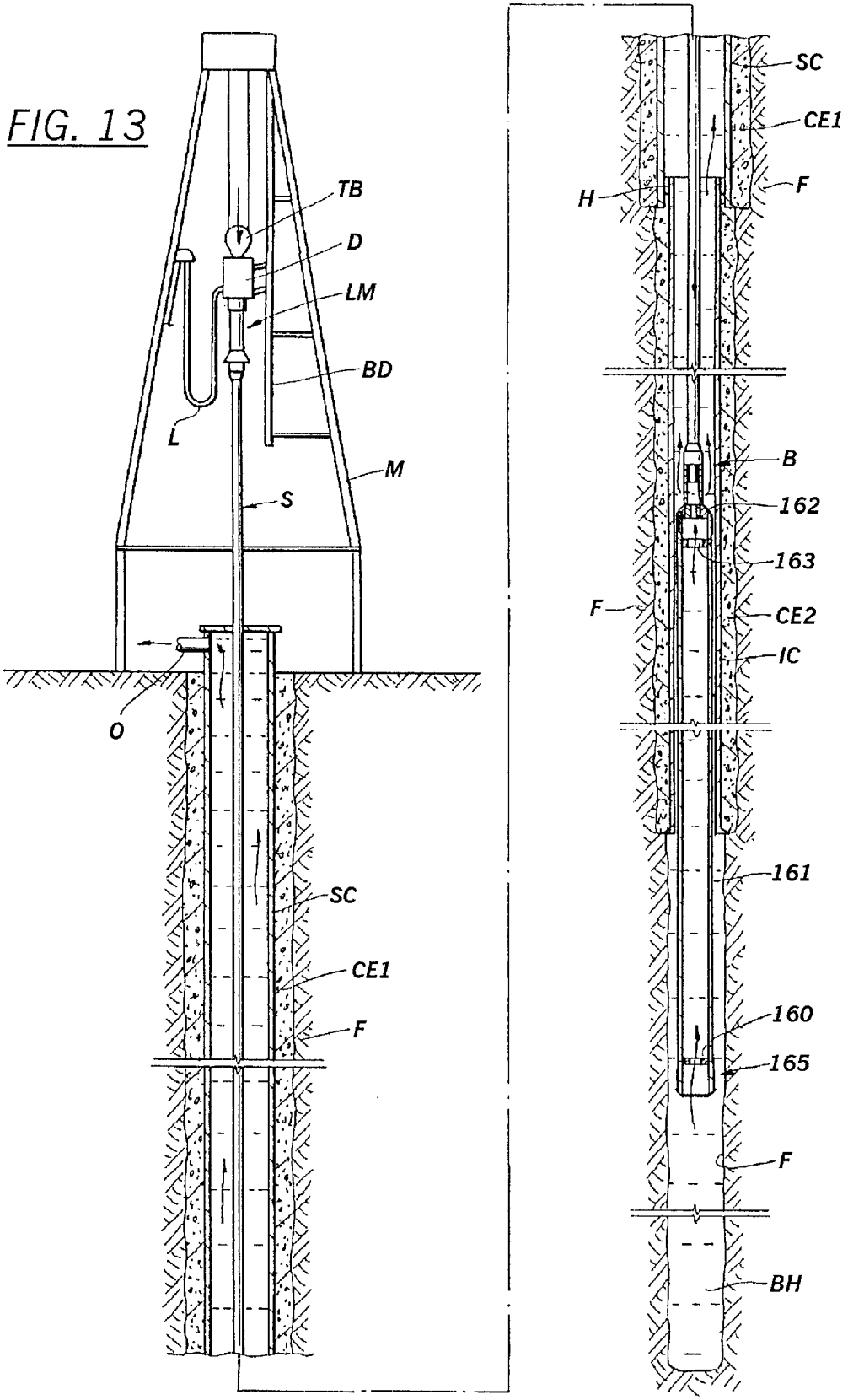
FIG. 13 is an elevation view of a wellbore depicting a casing liner being run downhole.

With reference first to FIG. 13, the general components of a system in which a tool in accordance with the present invention is used are illustrated. A mast M suspends a traveling block TB. The traveling block, in turn, supports a top drive TD which moves vertically on a block dolly BD. An influent drilling fluid line L supplies the top drive TD with drilling fluid from a drilling fluid reservoir (not shown). A launching manifold LM connects to a drill string S. The drill string S comprises numerous pipe elements which extend down into the borehole BH, and the number of such pipes is dependent on the depth of the borehole BH. A surge reduction bypass device B in accordance with the present invention is connected between the bottom end of drill string S and the top of casing hanger 162. A casing liner 161 is suspended from casing hanger 162. An open guide shoe 165 is fastened to the bottom of the casing hanger 162.

Solidified cement CE1 fixes a surface casing SC to the surrounding formation F. The surface casing SC contains an opening 0 in the uppermost region of the casing adjacent to the top. The opening 0 controls return of drilling fluid as it travels up the annulus between the drill string S and the surface casing SC.

Solidified cement CE2 fixes an intermediate casing IC to the surrounding formation F. The intermediate casing IC is hung from the downhole end of the surface casing SC by a mechanical or hydraulic hanger H.

The casing liner 161 includes a casing liner wiper plug 163 and a casing liner landing collar 160. The annulus between the drill string S and the intermediate casing IC is greater in area than the annulus between the casing liner 161 and the intermediate casing IC. While the invention is not intended to be limited to use in tight or close clearance casing runs, the benefits of the present invention are more pronounced in tight clearance running, since as the area is reduced and the pressure (pressure is equal to weight/area) is increased.

Figure 1A:
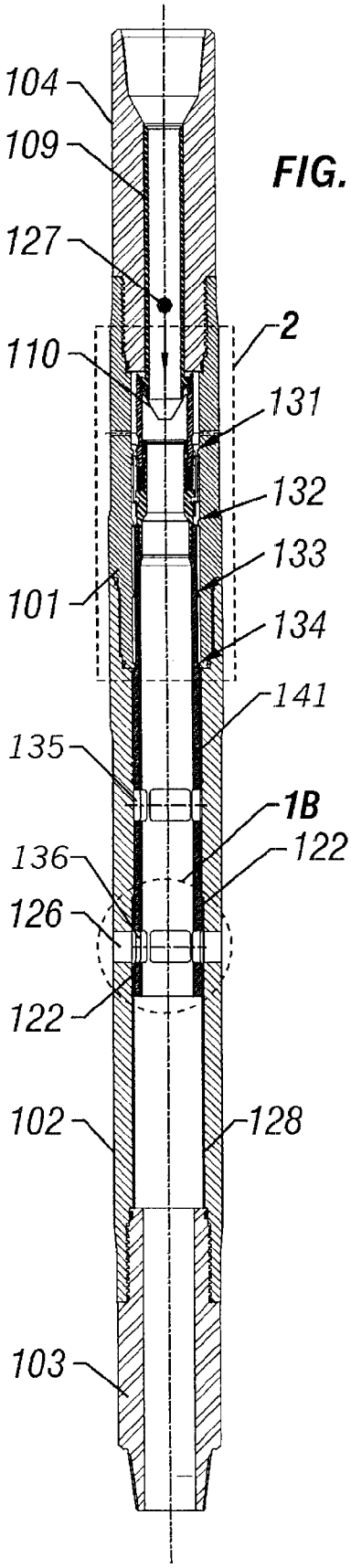
FIG. 1A is an elevation view of one embodiment of the present invention to illustrate the entire assembly in the initial open port position to facilitate surge reduction.
Figure 1B:
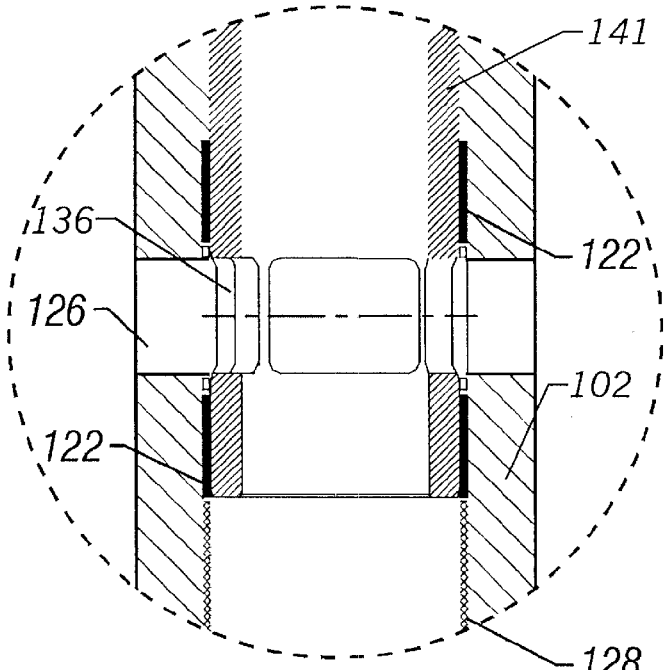
FIG. 1B is an enlarged view of the embodiment of FIG. 1A illustrating the housing flow ports and sleeve flow ports in an open position with seals above and below the flow ports.
Figure 2:
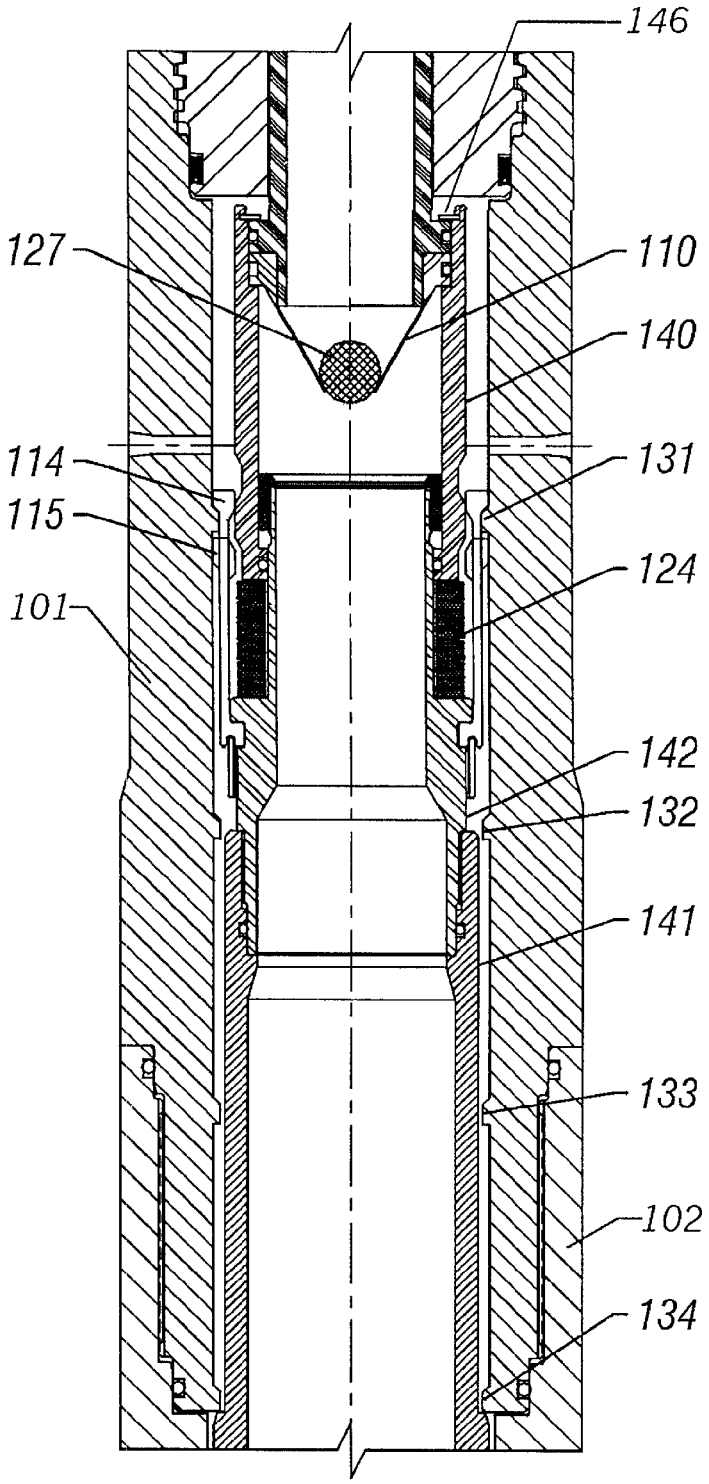
FIG. 2 is an enlarged detailed elevation view of the embodiment of FIG. 1A illustrating the indexing apparatus of the present invention.

With reference now to FIGS. 1 and 2, one embodiment of the surge reduction tool B (FIG. 13) of the present invention comprises a housing having upper housing 101 and a lower housing 102 which are in threaded engagement with one another. The lower end of top sub 104 is in threaded engagement with upper housing 101, and the upper end of top sub 104 is suitably connected to the drill string S (FIG. 13). The upper end of lower sub 103 is in threaded engagement with lower housing 102, and lower sub 103 is suitably connected to casing hanger CH (FIG. 13).

An indexing mechanism, shown in FIG. 2, is contained within the housing and has four latch positions 131, 132, 133, 134 designed to support axially downward indexing. Axially spaced internal protrusions or "rings " at positions 131, 132, 133, 134 are machined in the bore of the upper housing 101 that contains the latching mechanism. The axial spacing of these machined rings determines the specific position of the indexing mechanism at any given time.

With reference to FIG. 2, one implementation of the indexing mechanism of the present invention is illustrated. The yieldable seat assembly 110 is installed on a shoulder formed in sliding camming sleeve 140. The lower end of dart directing sleeve 109 is installed on top of the yieldable seat assembly 110, and a snap ring 146 is utilized to secure yieldable seat assembly 110 and dart directing sleeve 109 in place on the upper end of camming sleeve 140. The camming sleeve 140 is supported by spring washers 124. While any suitable spring washers may be used to support the camming sleeve, Belleville spring washers are preferred. The spring washers 124 are in turn supported on a threaded sleeve 142 that is connected with the top of a valving sleeve 141.

With reference to FIGS. 1A and 1B, at least two sets of axially spaced sleeve flow ports 135, 136 are formed in valving sleeve 141. Similarly, a plurality of housing flow ports 126 are formed in lower housing 102. As explained below, the valving sleeve 141 is indexed axially downward in the operation of a tool in accordance with the present invention. Initially, the axial position of valving sleeve 141 is such that sleeve flow ports 136 are aligned with housing flow ports 126. When the axial position of valving sleeve 141 is such that a set of sleeve flow ports is aligned with housing flow ports 126, valving sleeve 141 is in an "open port position." When the axial position of valving sleeve 141 is such that no set of sleeve flow ports is aligned with housing flow ports 126, valving sleeve 141 is in a "closed port position." The terms "open port position" and "closed port position" in the appended claims have the foregoing definitions.

Referring to FIG. 2, an embodiment of a tool in accordance with the present invention comprises an assembly of pivoting latching fingers 114, 115. One end of each latching finger 114, 115 is attached to the threaded sleeve 142. The assembly of latching fingers comprises both long fingers 114 and short fingers 115. The short fingers 115 are evenly interspersed among the long fingers 114 such that every other finger is a short finger. Each latching finger 114, 115 includes an external shoulder that rests on the internal machined indexing rings of the housing while also including an internal protrusion that interacts with the camming sleeve 140 so that the camming sleeve alternately forces the short or long latching fingers radially outward.

The short and long latching fingers 114, 115 are initially positioned to span across the top machined internal ring 131. The camming sleeve 140 is supported in the uppermost position by the spring washers 124 until a drop ball 127 lands in the yieldable seat 110. With the camming sleeve 140 in the uppermost position, the long latching fingers 114 are forced radially outward and thus the internal ring 131 of the housing restrains the indexing assembly from moving downward.

Figure 15:
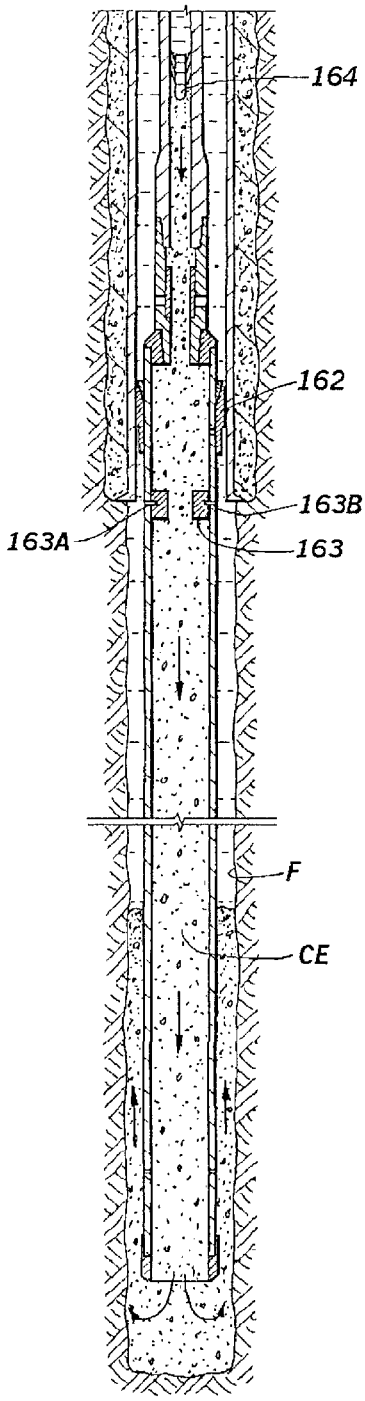
FIG. 15 is an elevation view of a casing shown in section view as concrete is pumped downward through casing.

Referring still to FIG. 2, a dart directing sleeve 109 fits in an opening in top sub 104 and functions to center a dart 164, shown in FIG. 15, on the seat of yieldable seat 110. Furthermore, the diameter of the dart directing sleeve 109 is less than the diameter of the drill pipe P, as shown in FIG. 13, which results in the dart being accelerated as it passes through the dart directing sleeve 109. The increased alignment accuracy and descent velocity of the dart within the dart directing sleeve 109 reduces the applied pressure required to yield the seat of yieldable seat assembly 110.

With reference to FIG. 1 and in particular FIG. 1B, a tool in accordance with the present invention also includes a packing assembly comprising chevron seals 122 in the lower housing 102. The chevron seals 122 are located in the interior of lower housing 102 above and below housing flow ports 126. The chevron seal located below housing flow port 126 sits on a spacer seal 128, and has the open position of the chevron seal facing downward. The chevron seal above the housing flow port 126 has the open portion of the chevron seal facing upward.

Method of Use

The method of use of a tool in accordance with the present invention provides for the running, hanging, and cementing of a casing downhole in a single running is now described.

Figure 3A:
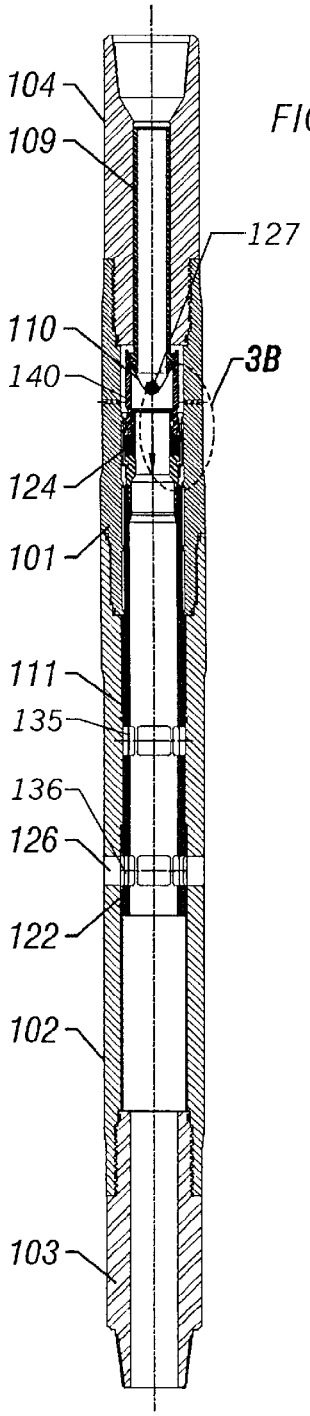
FIG. 3A is an elevation view of the embodiment of FIG. 1A illustrating the entire assembly as the first drop ball is dropped.
Figure 3B:
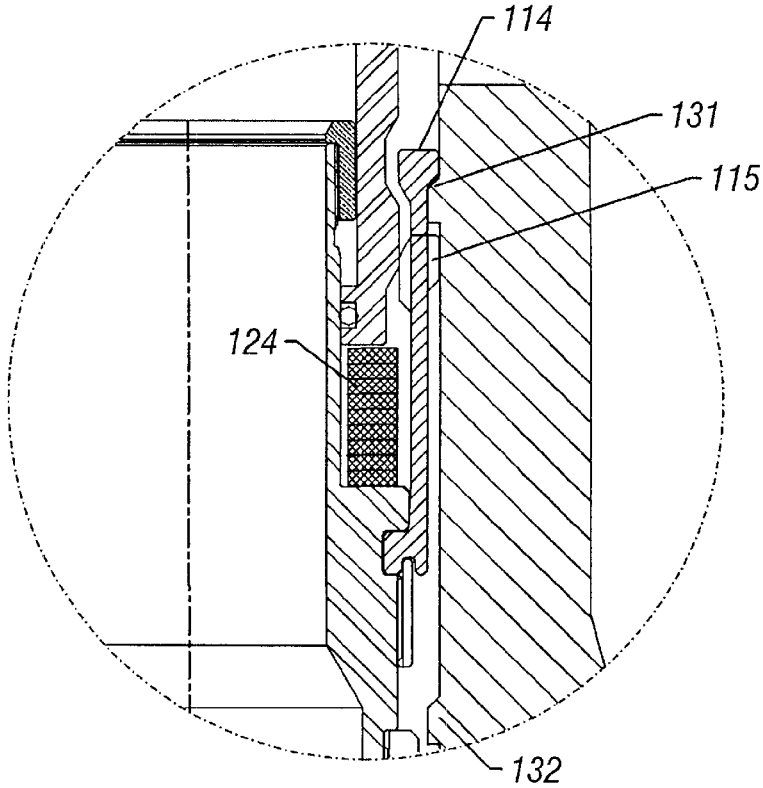
FIG. 3B is an enlarged view of a portion of FIG. 3A illustrating the state of the spring and latching fingers at the 131 position after the first drop ball has been dropped and pressure has been increased.

With reference to FIGS. 3A and 3B, the tool is run into a borehole with the camming sleeve 140 and valving sleeve 141 positioned such that the long latching fingers 114 are caught on the top face of the uppermost housing ring at latch position 131. Further, the position is such that the short fingers 115 are positioned immediately below the uppermost housing ring at latch position 131. In this "open port position," the sleeve flow ports 136 of valving sleeve 141 are aligned housing flow ports 126 and a flow path exists through the tool for drilling fluid to the annulus between the drill string and surface casing C2.

The casing liner 161 is run into the wellbore with the preferred embodiment of the present apparatus in open port position and thus the benefits of surge reduction are realized. However, if the casing liner 161 encounters a tight hole condition within the borehole, then circulation is required to free the casing liner, and the tool is moved to a closed port position as follows: A first drop ball 127 is dropped down the drill string S(FIG. 13), through the dart directing sleeve 109, and into the yieldable seat 110. The drilling fluid pressure is then increased behind the drop ball 127 and the yieldable seat 110 to a first predetermined level, which moves the seat 110 and camming sleeve 140 from its initial axial position downward against the resistance of the spring washers 124 to a second axial position. This downward axial movement frees the radial restraint on the long latching fingers 114 while simultaneously forcing the short latching fingers 115 radially outward.

Figure 4A:
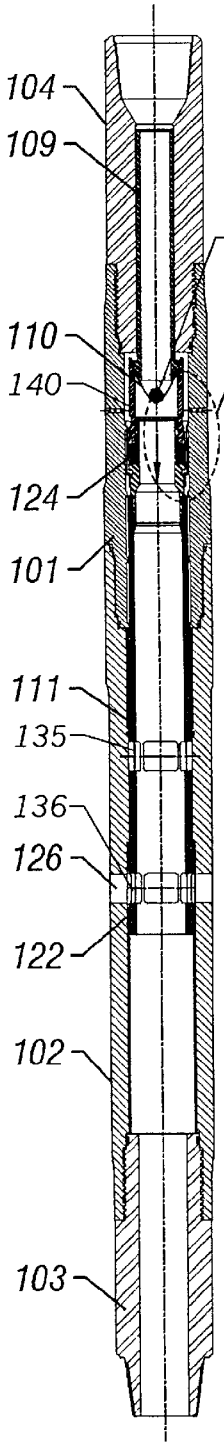
FIG. 4A is an elevation view of the embodiment of FIG. 1A illustrating the entire assembly as pressure is applied to the first drop ball and the seat with the flow ports open.
Figure 4B:
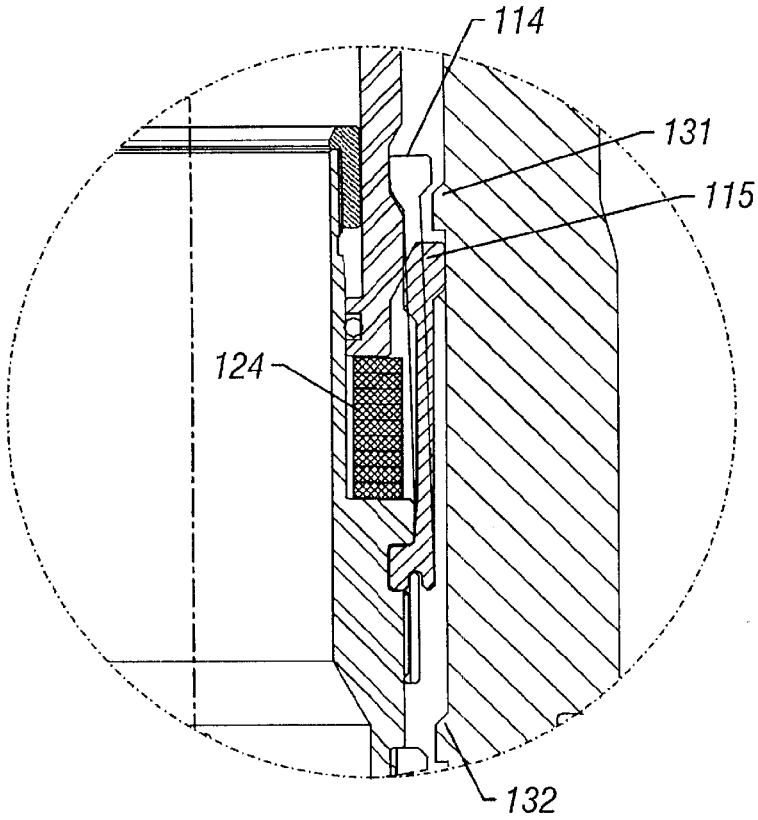
FIG. 4B is an enlarged view of a portion of FIG. 4A illustrating the state of the spring and latching fingers as pressure is applied to the first drop ball and seat.

With reference to FIGS. 4A and 4B, the inward radial motion of the long latching fingers 114 releases the indexing assembly and allows it, and the valving sleeve 141, to move axially downward. The simultaneous outward radial motion of the short latching fingers 115 provides an external protrusion that will catch the short fingers 115 on the next lower ring at latch position 132.

Figure 5A:
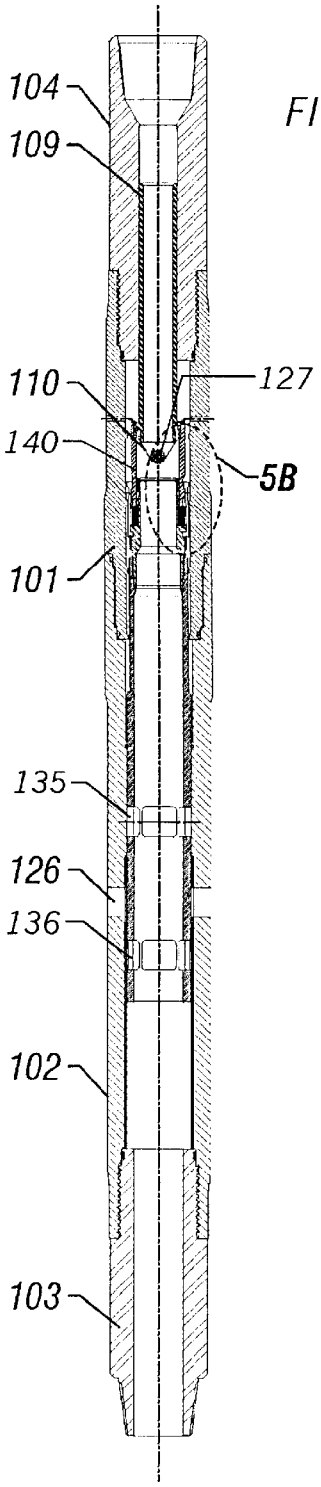
FIG. 5A is an elevation view of the embodiment of FIG. 1A illustrating the entire assembly in the first closed port position.
Figure 5B:
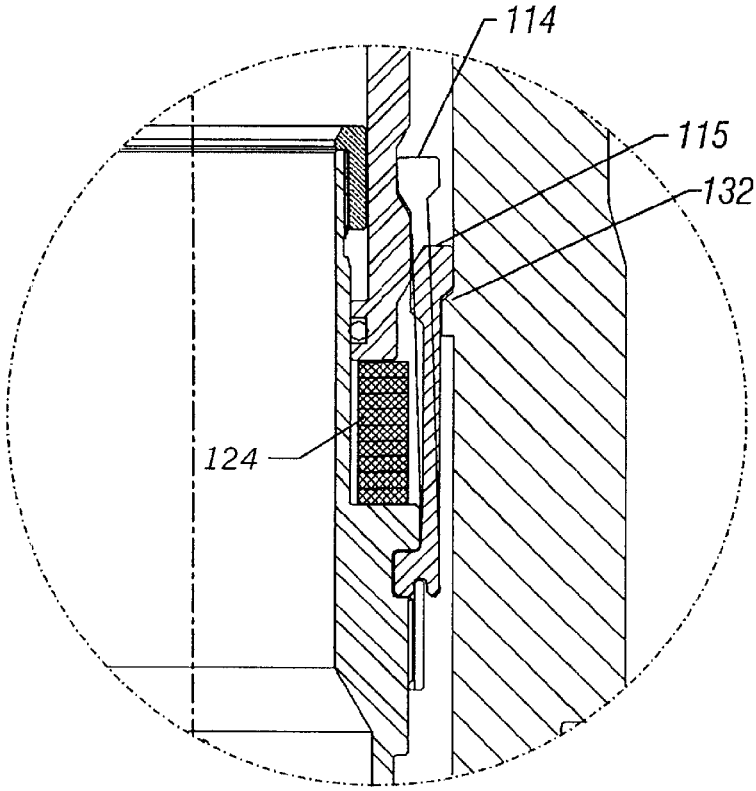
FIG. 5B is an enlarged view of a portion of FIG. 5A illustrating the state of the spring and latching fingers at the 132 position.

With reference to FIGS. 5A and 5B, the downward movement of the indexing assembly and attached valving sleeve is arrested at latch position 132.

Figure 6A:
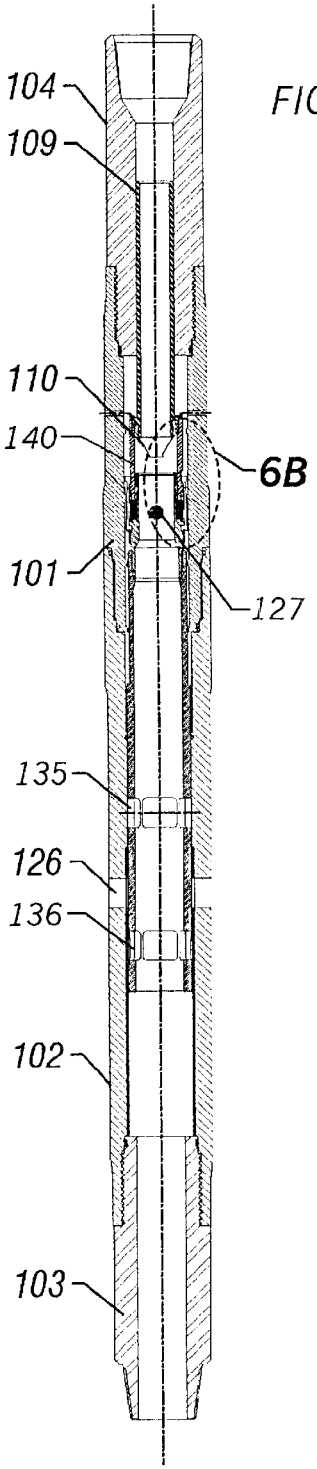
FIG. 6A is an elevation view of the embodiment of FIG. 1A illustrating the entire assembly as the first drop ball is blown through the seat.
Figure 6B:
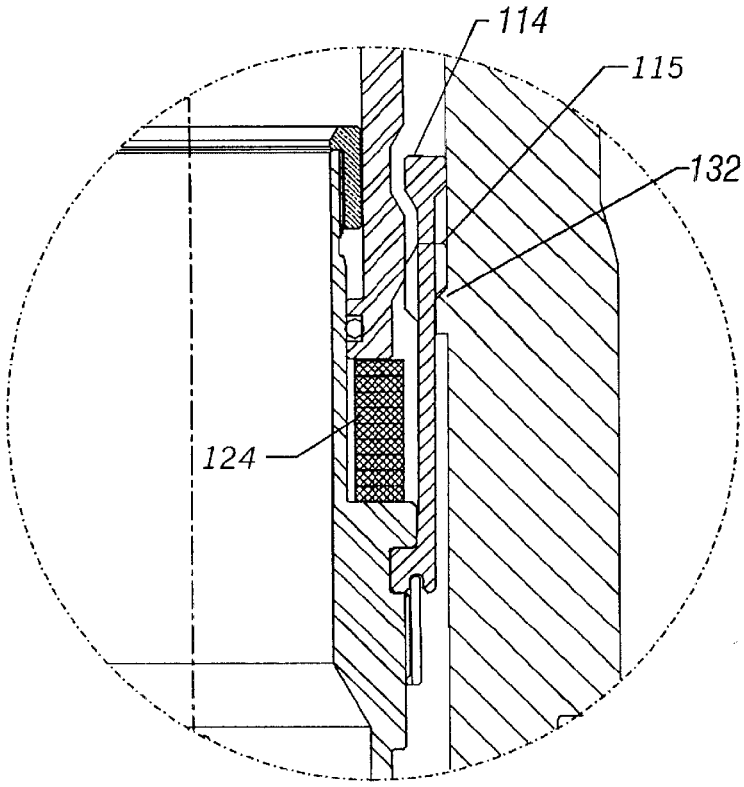
FIG. 6B is an enlarged view of a portion of FIG. 6A illustrating the state of the spring and latching fingers at the 132 position.

With reference to FIGS. 6A and 6B, the pressure above the drop ball is then increased further to a second predetermined level where the yieldable seat 110 yields to an extent that permits the drop ball 127 to pass through the yieldable seat 110 and on down to the bottom of the borehole. At this state, the valving sleeve 141 is in a closed port position, and of drilling fluid can be established to help work the casing liner 161 through the tight hole condition.

Figure 7A:
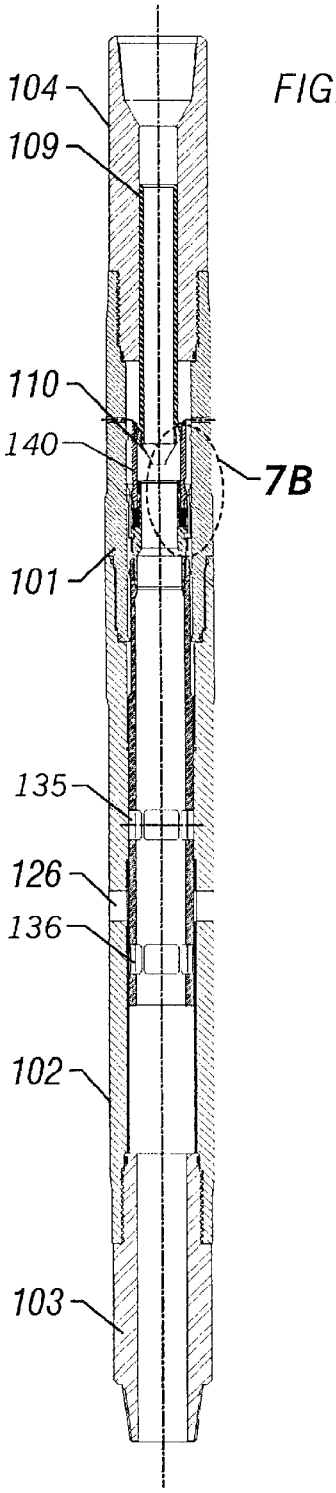
FIG. 7A is an elevation view of the embodiment of FIG. 1A illustrating the entire assembly after the first ball is blown out of the housing.
Figure 7B:
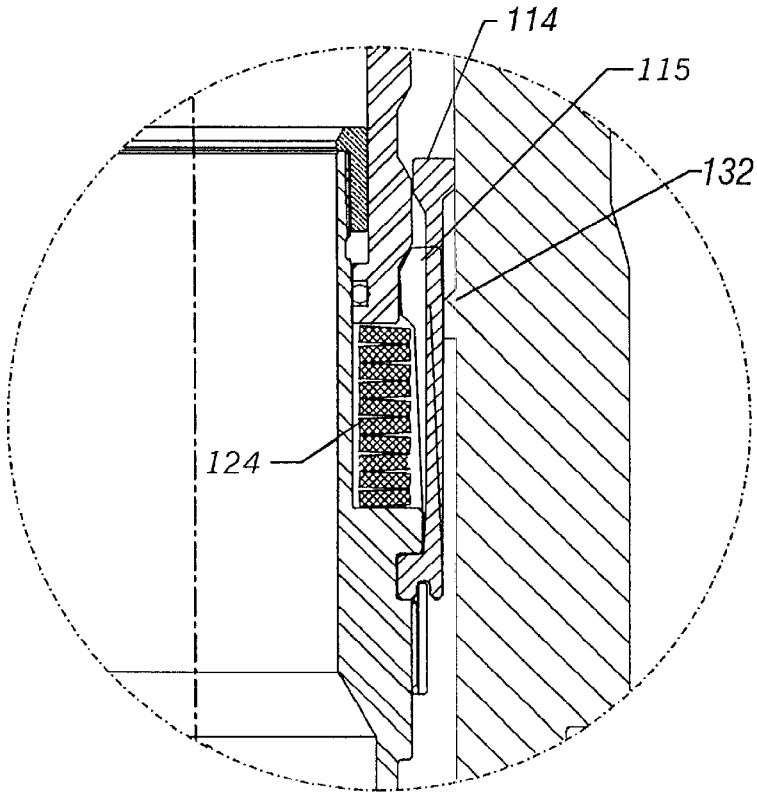
FIG. 7B is an enlarged view of a portion of FIG. 7A illustrating the state of the spring and latching fingers at the 132 position with a camming sleeve reset to release the short fingers and to support the long fingers.

With reference to FIGS. 7A and 7B, once the drop ball 127 passes the yieldable seat 127 and the pressure is freed from the spring washers 124, the spring washers 124 reset and push the camming sleeve slightly back up so that the short latching fingers 115 are free to move radially inward and the long fingers 114 are forced radially outward.

Figure 8A:
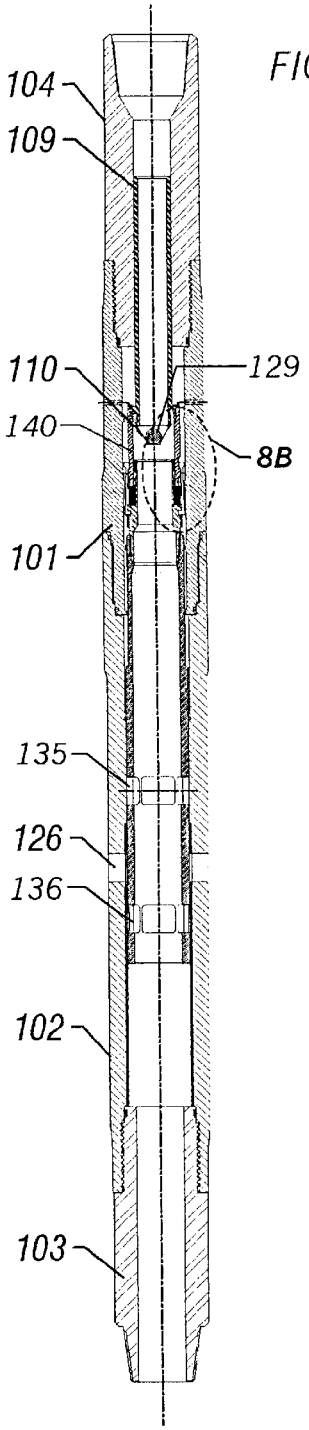
FIG. 8A is an elevation view of the of FIG. 1A illustrating the entire assembly after the second ball is seated to reopen the flow parts.
Figure 8B:
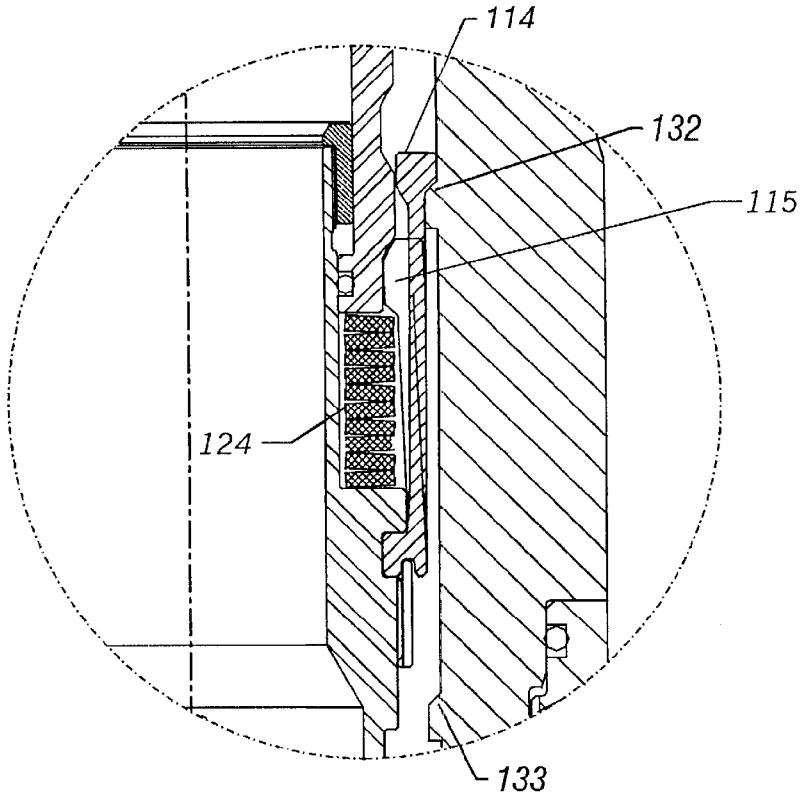
FIG. 8B is an enlarged view of a portion of FIG. 8A illustrating the state of the spring and latching fingers at the 132 position prior to increasing pressure above the drop ball.

With reference to FIGS. 8A and 8B, the valving sleeve then slips slightly downward so that the radially protruding long fingers 114 catch on the ring at latch position 132. Once circulation of the drilling fluid frees the casing from the tight hole condition, downhole running operations can continue and surge reduction can be reestablished to finish running the casing to the total depth.

To move the valving sleeve 141 to the next open port position, a drop ball 129 with diameter larger than the previous drop ball 127 is dropped down the drill string (FIG. 13), through the dart directing sleeve 109, and into the yieldable seat 110. The pressure of the drilling fluid above the drop ball 129 and the seat 100 is then increased to a predetermined level, which moves the seat 110 and camming sleeve 140 axially downward against the resistance of the spring washers 124. This downward movement frees the radial restraint on the long latching fingers 114 while simultaneously forcing the short latching fingers 115 radially outward. The inward radial motion of the long latching fingers 114 releases the indexing assembly and allows it, and the valving sleeve 141, to move downward. The simultaneous outward radial motion of the short latching fingers 115 provides an external protrusion that will catch the short fingers 115 on the next lower ring at latch position 133. The downward movement of the indexing assembly and attached valving sleeve is arrested at latch position 133. At this state, the housing flow ports 126 are aligned with sleeve flow ports 135 and the valving sleeve is once again in an open port position. Running in of the casing liner 161 can then resume with the benefits of surge reduction.

Figure 9A:
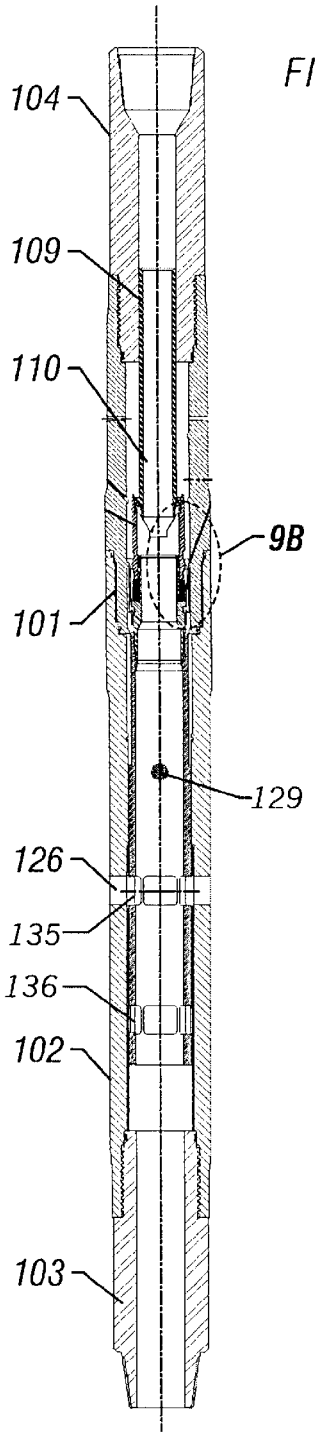
FIG. 9A is an elevation view of the embodiment of FIG. 1A illustrating the entire assembly after the second drop ball is blown through the seat.
Figure 9B:
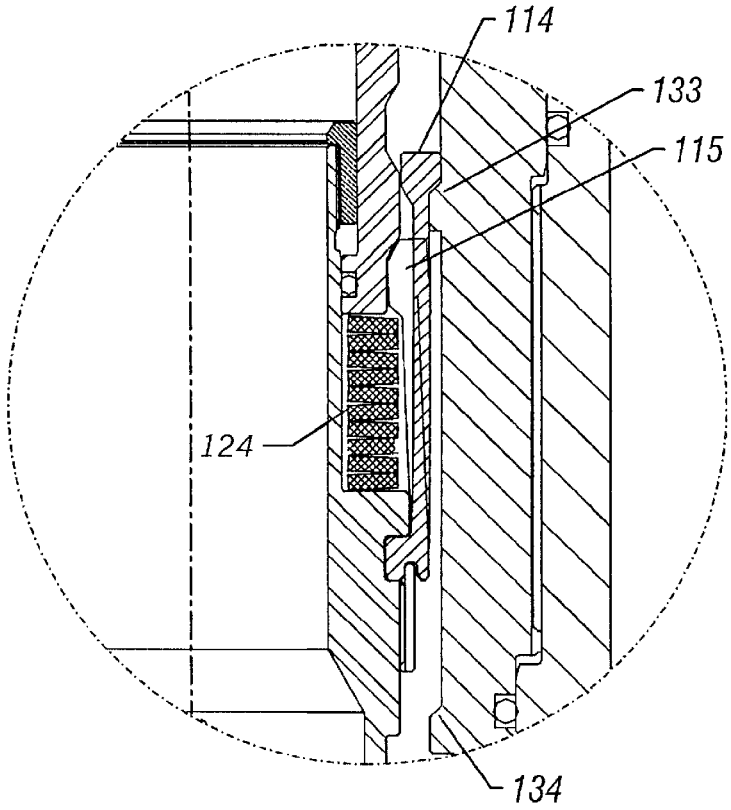
FIG. 9B is an enlarged view of a portion of FIG. 9A illustrating of the state of the spring and latching fingers at the 133 position.

With reference to FIGS. 9A and 9B, the drilling fluid pressure is then increased to a higher predetermined level above the drop ball 129 where the yieldable seat 110 yields to an extent that permits the drop ball 129 to pass through the yieldable seat 110 and on down to the bottom of the borehole. It should be noted that the diameters of drop balls 127 and 129 must be small enough to pass through the openings in wiper plug 162 and landing collar 160. Thus, the maximum diameters of drop balls 127 and 129 will be dictated by the type of float equipment that is used.

Once the drop ball 129 passes the yieldable seat 110 and the pressure is freed from the spring washers 124, the spring washers 124 reset and push the camming sleeve slightly back up so that the short latching fingers 115 are free to move radially inward and the long fingers 114 are forced radially outward. The valving sleeve then slips slightly downward so that the radially protruding long fingers 114 catch on the ring at latch position 133.

Figure 10A:
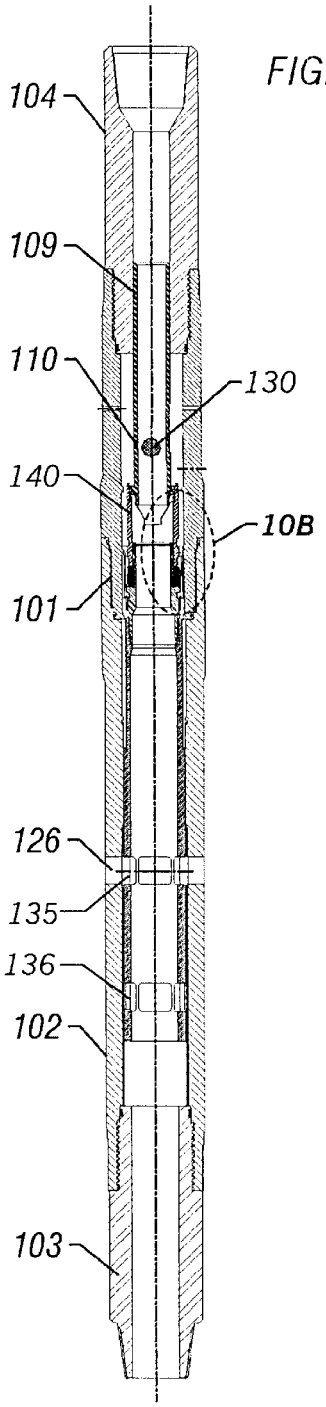
FIG. 10A is an elevation view of the embodiment of FIG. 1A illustrating the entire assembly as the third drop ball is dropped into the housing to reclose the flow ports.
Figure 10B:
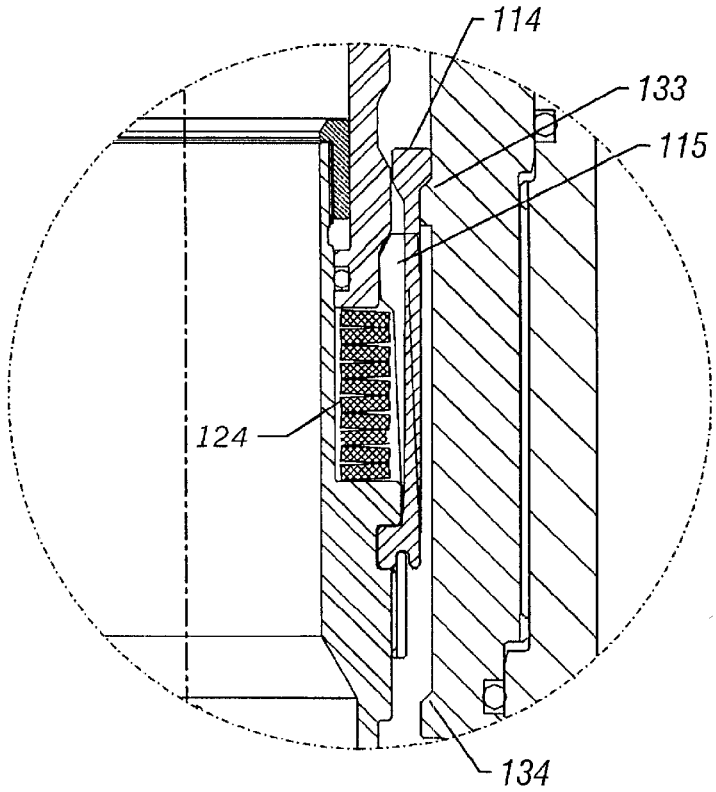
FIG. 10B is an enlarged view of a portion of FIG. 10A illustrating the state of the spring and latching fingers at the 133 position prior to applying pressure above the third ball.

With reference to FIGS. 10A and 10B, once the casing has reached the final depth, then a final pressurization cycle must be completed in order to shift the valving sleeve 141 into the second closed port position. A final drop ball 130, with diameter still larger than the previous drop ball 129, is dropped down to the yieldable seat 110. Drilling fluid pressure increased to a predetermined level above the drop ball 130 and the yieldable seat 110, which moves the seat 110 and camming sleeve 140 downward against the resistance of the spring washers 124. This downward movement frees the radial restraint on the long latching fingers 114 while simultaneously forcing the short latching fingers 115 radially outward. The inward radial motion of the long latching fingers 114 releases the indexing assembly and allows it, and the valving sleeve 141, to move downward. The simultaneous outward radial motion of the short latching fingers 115 provides an external protrusion that will catch the short fingers 115 on the next lower ring at latch position 134. The downward movement of the indexing assembly and attached valving sleeve is arrested at latch position 134. At this state, the vent port 126 is aligned in the closed position and the casing is at the final depth of the wellbore facilitating cementing operations.

Figure 11A:
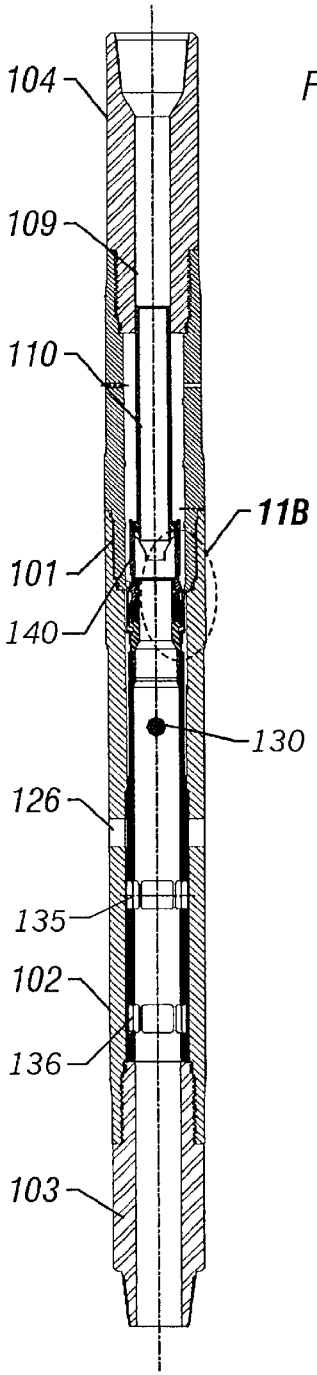
FIG. 11A is an elevation view of the embodiment of FIG. 1A illustrating the entire assembly shifted downward after the third drop ball is blown through the seat.
Figure 11B:
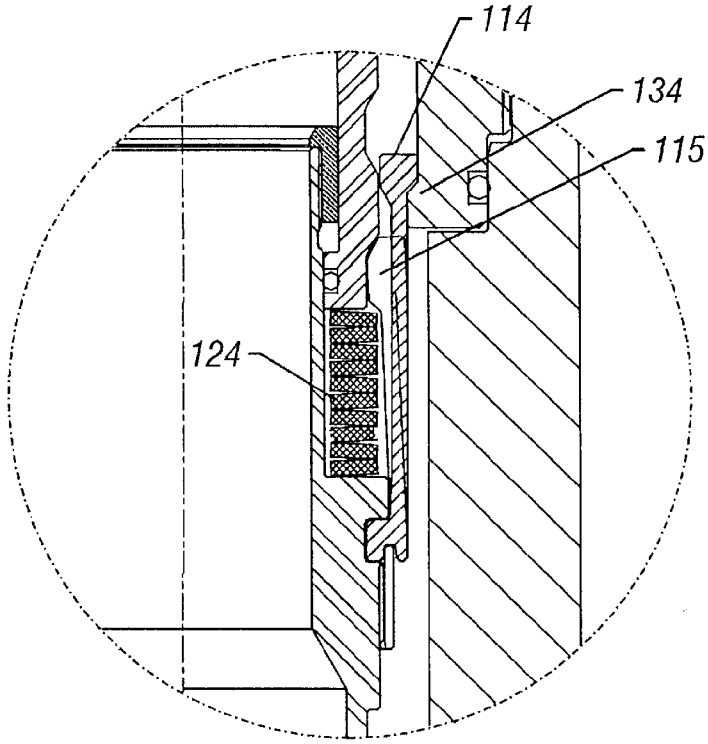
FIG. 11B is an enlarged view of a portion of FIG. 11A illustrating the state of the spring and latching fingers at the 134 position.
Figure 14:
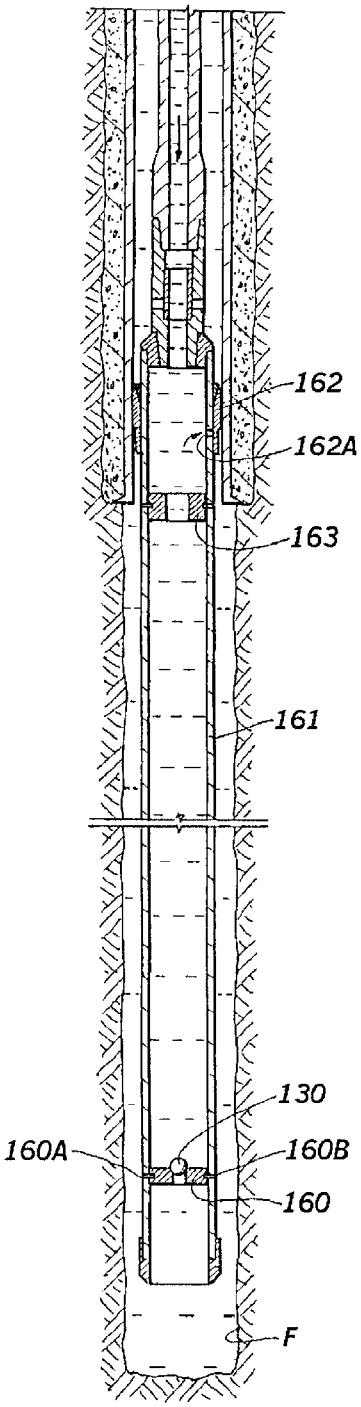
FIG. 14 is an elevation view of a casing shown in section view at final depth of a downhole run.

With reference to FIGS. 11A and 11B, the drill fluid pressure is then increased further to a higher predetermined level above the drop ball 130 where the yieldable seat 110 yields to an extent that permits the drop ball 130 to pass through the yieldable seat 110 and on down to the seat of the landing collar 160, shown in FIG. 14. Once the drop ball 130 passes the yieldable seat 127 and the pressure is freed from the spring washers 124, the spring washers 124 reset and push the camming sleeve slightly back up so that the short latching fingers 115 are free to move radially inward and the long fingers 114 are forced radially outward. The valving sleeve then slips slightly downward so that the radially protruding long fingers 114 catch on the ring at final latch position 134.

While the surge reduction tool described above has a housing with one set of housing flow ports and a valving sleeve with two sets of axially spaced sleeve flow ports, it will be appreciated that a tool in accordance with the present invention may comprise a housing with two sets of axially spaced housing flow ports and a valving sleeve with one set of sleeve flow ports.

With reference to FIG. 14, the drilling fluid pressure is increased inside the casing liner 161 to actuate the hydraulic casing liner hanger 162 via casing liner hanger port 162A. Drilling fluid pressure is again increased until the shear pins 160A and 160B fail and the drop ball 130 and landing collar 160 fall out of casing liner 161 and into borehole.

With reference to FIG. 15, once the casing liner is set, cementing operations are commenced. Cement C is pumped down the drill pipe P and through the casing 161. Once the proper quantity of cement has been pumped into the drill pipe, a dart 164 is released from the surface into the drill pipe P and drops onto the cement. Pressurized drilling fluid is then used to push the dart 164 through the dart directing sleeve and pass the yielded seat. The dart 164 enters the casing 161 and engages the wiper plug 163.

Figure 16:
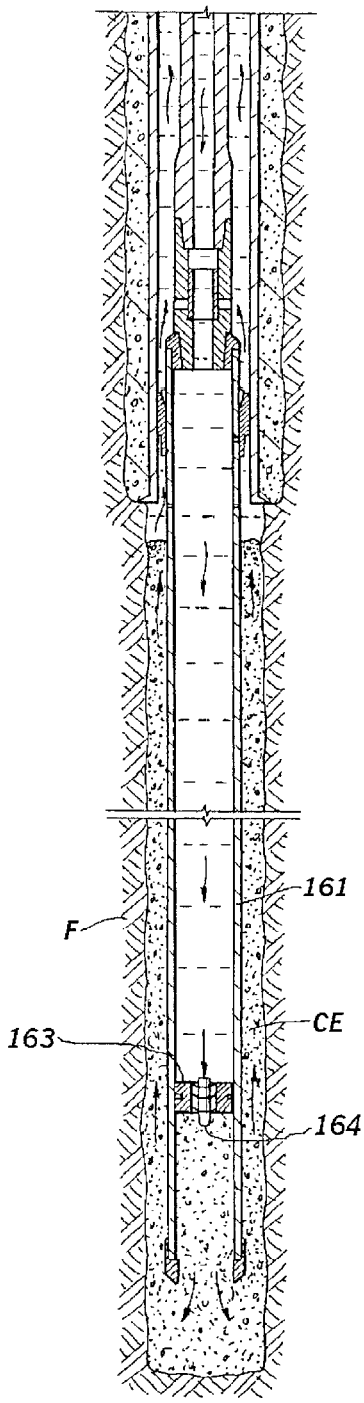
FIG. 16 is an elevation view of a casing shown in section view as concrete is forced from casing up into annulus.

With reference to FIG. 16, drilling fluid pressure is then increased behind the dart until plug shear pins 163A and 163B fail allowing the plug 163 to move downwardly and push the cement C through the casing 161 and up into the annulus between the borehole and casing until the plug 163 engages in the collar 160. Finally, the surge reduction tool is retrieved from the borehole.

Figure 12:
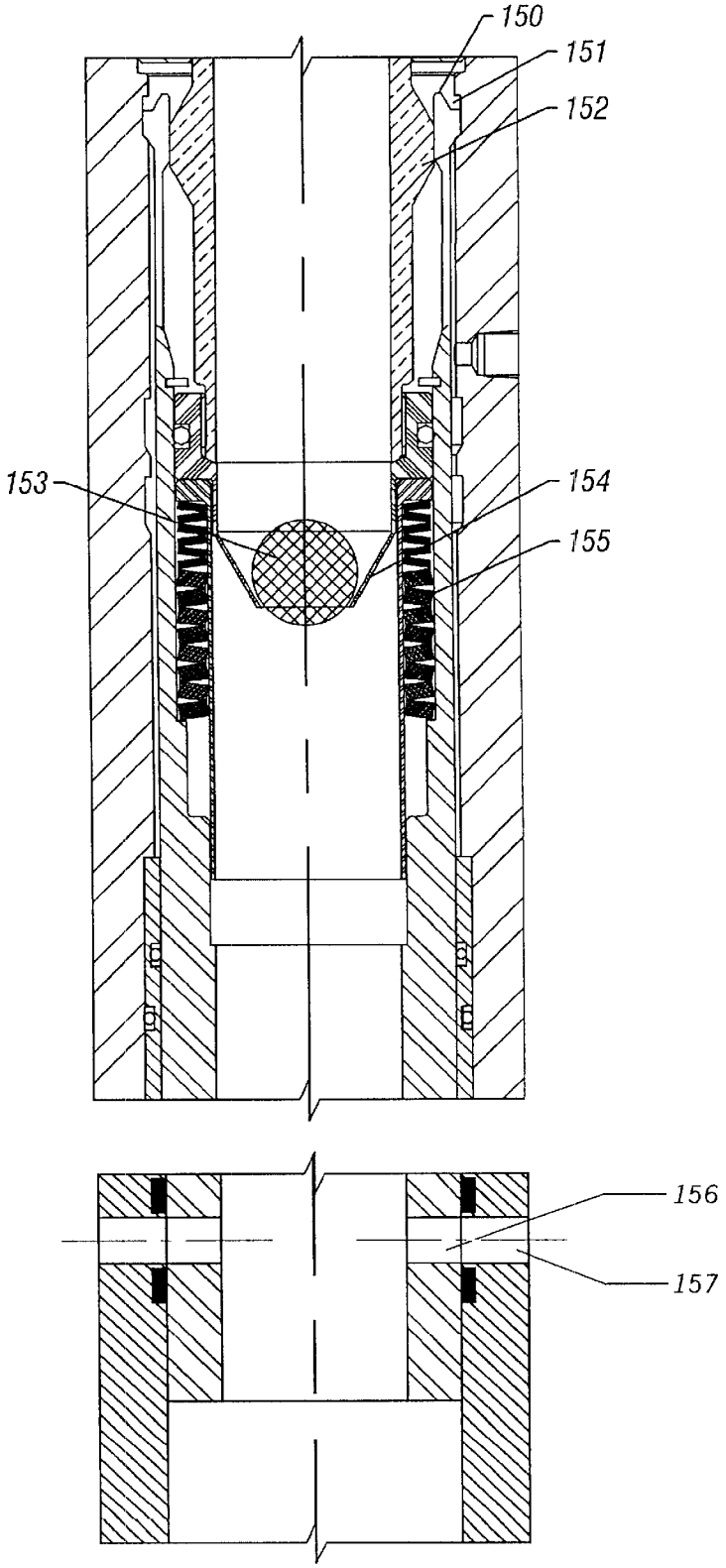
FIG. 12 is an enlarged elevation view of another embodiment of the present invention comprising only one length of fingers and facilitating only one sequencing between open port position and closed port position.

With reference now to FIG. 12, an improved design for a surge reduction tool without multiple open and closed port positions is also disclosed. This design includes latching fingers 150 which engage with a housing ring 151. In this initial position the latching fingers 150 are held in place by a camming sleeve 152. Surge reduction is provided when the tool is in this initial position because sleeve flow ports 156 are aligned with a set of housing flow ports 157. When the tool has been lowered to its final depth, a ball 153 is dropped onto a yieldable seat 154 and the system is pressurized above drop ball 153. As the pressure increases the camming sleeve 152 is moved downward to depress the spring washer 155. As the camming sleeve 152 moves downward, the latching fingers 150 move radially inward, which allows the vent holes to be shut off. By using the spring washer 155, the pressure at which the surge reduction tool closes is more predictable. Spring washer 155 is preferably a Belleville spring washer.

Figure 17:
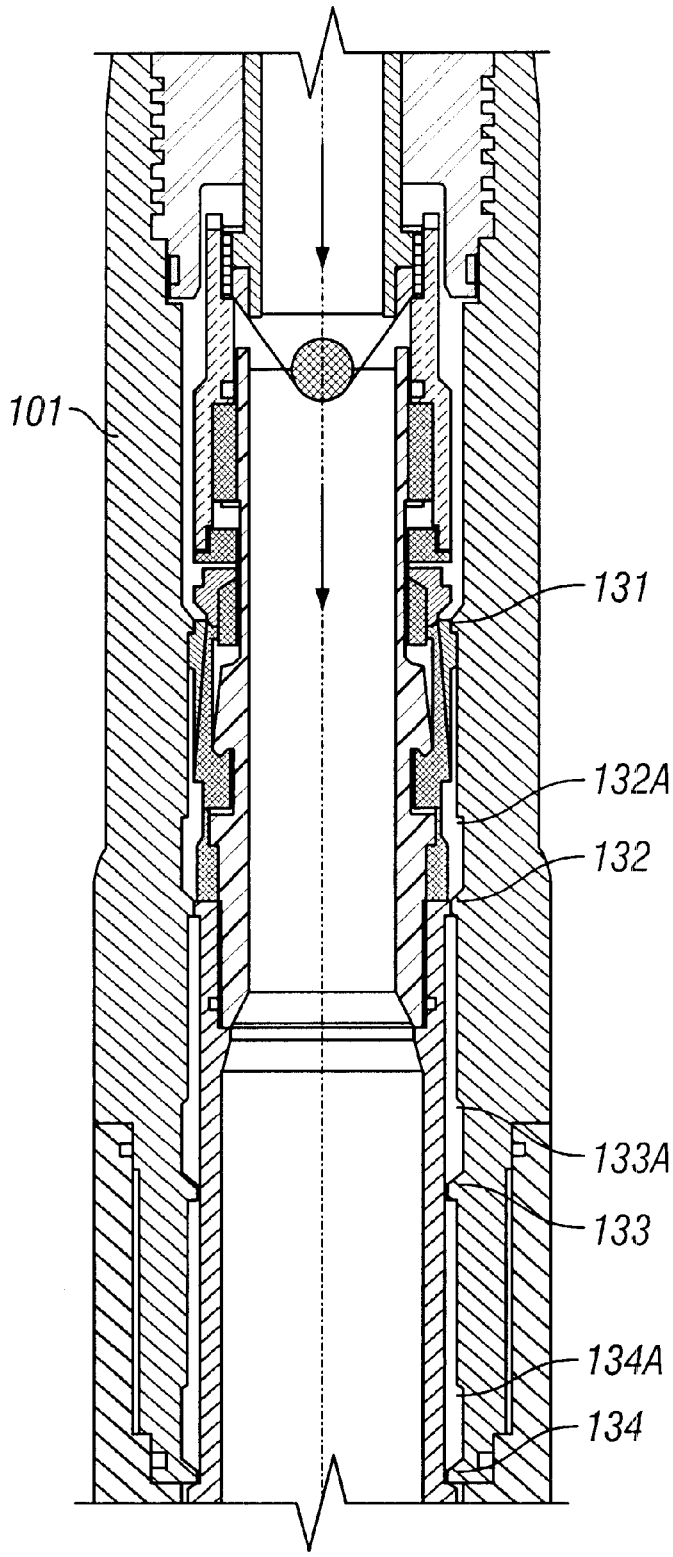
FIG. 17 is an elevation view of another embodiment of the invention comprising an alternative arrangement of the axially indexing mechanism.
Figure 17A:
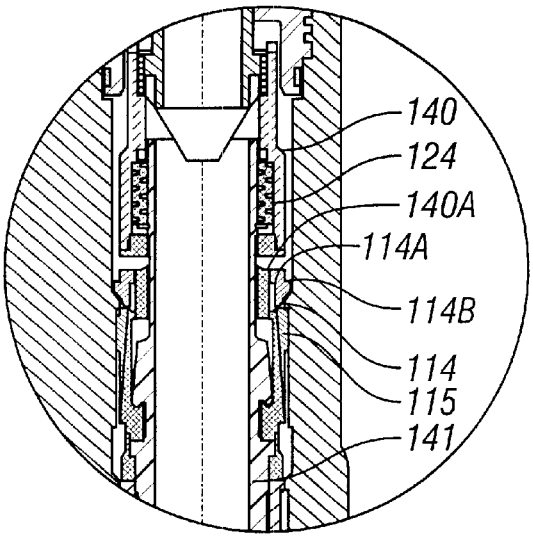
FIG. 17A is an enlarged elevation view of the axially indexing mechanism in initial position.
Figure 17B:
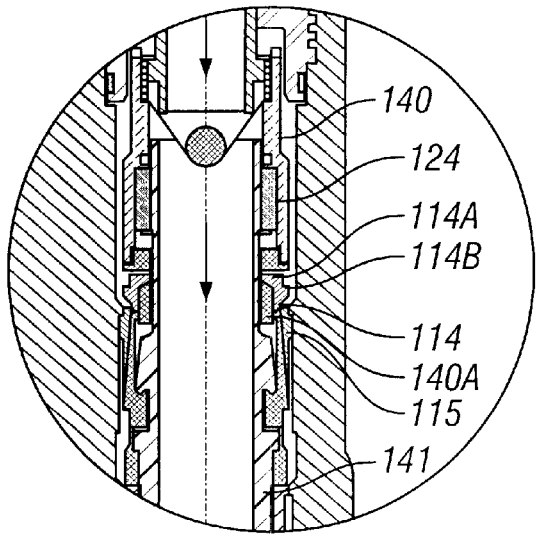
FIG. 17B is an enlarged elevation view of the axially indexing mechanism illustrating long latching finger in locked position with camming sleeve.
Figure 17C:
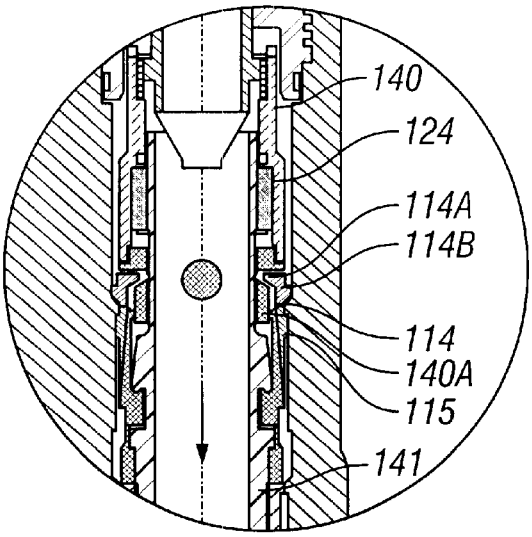
FIG. 17C is an enlarged elevation view of the axially indexing mechanism illustrating long latching finger unlocking with camming sleeve.

With reference to FIGS. 17 and 17A, an alternative indexing mechanism for a tool in accordance with the present invention further comprises long latching fingers 114 each having a hook 114A and a ledge 114B, a camming sleeve 140 having a catch 140A, and machined rings in upper housing 101 at latch positions 132, 133, 134 having recesses 132A, 133A, 134A located immediately above each ring. In operation, long latching fingers 114 initially engage ring 131 to prevent downward movement of camming sleeve 140 and valving sleeve 141. As camming sleeve 140 is forced axially downward, catch 140A of the camming sleeve allows hook 114A of long latching fingers 114 to move radially inward to lock camming sleeve 140 against the compression force of spring washers 124 (illustrated in FIG. 17B). As the long latching fingers 114 disengage with housing ring 131, camming sleeve 140 and valving sleeve 141 move axially downward. During descent, the camming sleeve 140 remains in the locked position. As short latching fingers 115 encounter recess 132A, the short latching fingers move radially outward to engage housing ring 132 and arrest the downward motion of camming sleeve 140 and valving sleeve 141 (illustrated in FIG. 17C). At latch position 132, ledge 114B of long latching fingers 114 slides into recess 132A allowing the long latching fingers to move radially outward thereby unlocking camping sleeve 140. Once unlocked, camming sleeve 140 is moved slightly upwards by the compression force of spring washers 124. This same sequence may be repeated for latch positions 133 and 134.

What is claimed is:

1. Apparatus for use in reducing surge pressure while running a tubular member in a borehole containing drilling fluid, which comprises:

a housing having a top end and having a bottom end for connection to a casing hanger, said housing having at least one set of housing flow ports formed therein;

a drill pipe connected to the top end of the housing for suspending the housing and the tubular member and for providing a communication conduit between a drilling rig and the borehole;

a valving sleeve within the housing, which valving sleeve has at least two sets of sleeve flow ports formed therein at spaced axial locations, the valving sleeve being initially positioned in the housing such that a first open port condition exists; and indexing apparatus for axially moving the valving sleeve downward from the first open port position to a first closed port position, from the first closed port position to a second open port position and from the second open port position to a second closed port position.

2. The apparatus of claim 1, wherein the indexing apparatus comprises:

a plurality of protrusions that are formed in the housing at axially spaced locations;

a threaded sleeve which is attached to the top of the valving sleeve;

a plurality of latching fingers having first and second ends, the first ends of said latching fingers being attached to the threaded sleeve and the second ends of said latching fingers being machined to engage the protrusions in the housing, some of the latching fingers having a length which is longer than the length of the remainder of the latching fingers;

spring washers which are supported by the threaded sleeve; and a camming sleeve including a yieldable ball seat, which camming sleeve is supported by the spring washers and movable from a first axial position to a second axial position, where the camming sleeve in said first axial position contacts the second ends of the longer latching fingers to force them into engagement with one of the protrusions in the housing and where the movement of the camming sleeve to the second axial position releases the longer latching fingers from engagement with the protrusion and forces the second ends of the shorter latching fingers into contact with the inside of the housing.

3. The apparatus of claim 2, further comprising:

a first ball which is dropped down the drill string which seats in said yieldable ball seat;

means for establishing a pressure above the first ball which is sufficient to move the camming sleeve from its first axial position to its second axial position and to move the valving sleeve from the first open port position to the first closed port position; and means for establishing a second pressure above the first ball which is sufficient to force the first ball through the yieldable ball seat.

4. The apparatus of claim 3, further comprising:

a second ball which is dropped down the drill string and which seats in said yieldable ball seat, said second ball having a larger diameter than said first ball;

means for establishing a pressure above the second ball which is sufficient to move the camming sleeve from its first axial position to its second axial position and to move the valving sleeve from the first open port position to the first closed port position; and means for establishing a second pressure above the second ball which is sufficient to force the second ball through the yieldable ball seat.

5. The apparatus of claim 4, further comprising:

a third ball which is dropped down the drill string and which seats in said yieldable ball seat, said third ball having a larger diameter than said second ball;

means for establishing a pressure above the third ball which is sufficient to move the camming sleeve from its first axial position to its second axial position and to move the valving sleeve from the first open port position to the first closed port position; and means for establishing a second pressure above the third ball which is sufficient to force the third ball through the yieldable ball seat.

6. The apparatus of claim 1, further comprising seals positioned between the housing and the valving sleeve and arranged above and below the housing flow port on the inside of the housing.

7. Apparatus of claim 1, further comprising a dart directing sleeve arranged between the drill pipe and the seat and providing a passage for a dart to travel from the drill pipe and into the seat, said sleeve having a smaller diameter and smoother inside wall than the drill pipe.

8. Apparatus for use in reducing surge pressure while running a tubular member in a borehole containing drilling fluid, which comprises:

a housing having a top end and having a bottom end for connection to a casing hanger, said housing having at least two sets of housing flow ports formed therein at axially spaced locations;

a pipe connected to the top end of the housing for suspending the housing and tubular member and for providing a communication conduit between a drilling rig and the borehole;

a valving sleeve within the housing, which valving sleeve has a set of sleeve flow ports formed therein, the valving sleeve being initially positioned in the housing such that a first open port condition exists; and indexing apparatus for axially moving the valving sleeve downward from the first open port position to a first closed port position, from the first closed port position to a second open port position and from the second open port position to a second closed port position.

9. The apparatus of claim 8, further comprising seals positioned between the housing and the sleeve and arranged above and below the housing flow ports on the inside of the housing.

10. The apparatus of claim 8, further comprising a dart directing sleeve arranged between the drill pipe and the seat and providing passage for a dart to travel from the drill pipe and into the seat, said dart directing sleeve having a smaller diameter and smoother inside wall than the drill pipe.

11. A method for reducing surge pressure while running in a tubular member in a borehole containing drilling fluid, comprising:

connecting a surge reduction device between the drill string and the casing liner, the surge reduction device having a plurality of alternating open port and closed port positions and having an internal sleeve that can be moved downwardly from one port position to the next;

lowering the tubular member into the wellbore with the surge reduction device in the first open port position;

moving the sleeve of the surge reduction device downward from the first open port position to the first closed port position;

moving the sleeve of the surge reduction device downward from the first closed port position to the second open port position; and moving the sleeve of the surge reduction device downward from the second open port position to the second closed port position.

12. The method of claim 11, wherein each step of moving the movable sleeve comprises:

dropping a ball into a seat, said ball sealing with the seat;

increasing drilling fluid pressure to a first predetermined level above the ball and against the sleeve to move the sleeve downward; and further increasing drilling fluid pressure to a second predetermined level above the ball to expand the seat to allow the ball to pass through the seat.

13. A system for reducing surge pressure while running drilling fluid in a borehole, and fixing the casing within the borehole, said system comprising:

a housing connected between a drill pipe and a casing hanger, said housing having an opening at its top end and an opening at its bottom end and at least one housing flow port to permit drilling fluid to flow from inside the housing into the annulus above the housing while running downhole;

a sleeve in the housing which is initially in an open port position while running downhole, and which is axially movable to closed port position, and then axially movable to an open port position and then axially movable to closed port position;

a plurality of drop balls; and a seat connected to the sleeve said sleeve movable between a plugged condition and yielding condition, said movement occurring when one of the drop balls is in said seat and drilling fluid pressure is increased above the ball to a first predetermined level.

14. The system of claim 13, wherein it further comprises means for increasing the drilling fluid pressure to a second predetermined level to blast the drop ball through the seat and create a passage through the housing for drilling fluid to flow.

15. The system of claim 13, further comprising a dart directing sleeve residing within the housing and arranged between the drill pipe and the seat.

16. The system of claim 13, further comprising a dart which is dropped into the drill pipe, and a dart directing sleeve in the housing through which the dart passes, and which seats into the seat, said dart being pressured with drilling fluid to push a predetermined amount of cement through the casing and into annulus between the casing and the borehole thereby fixing the casing.

17. An apparatus for reducing surge pressure while running in a casing through drilling fluid and down a borehole, said apparatus comprising:

a housing releasably connecting to a drill string and having an opening at a top end and an opening at a bottom end and at least one housing flow port to permit the flow of drilling fluid from the housing into an annulus above the housing when in one open port position;

at least one sliding sleeve in the housing and a latching mechanism to index the sleeve axially downward, said sleeve having more than one sleeve flow ports at different axial locations along the sleeve and movable axially downward between an open port position and closed port position;

a seat connected with the sleeve and moveable between a plugged position and yield position;

a ball which is dropped through the drill string and which plugs the seat; and means for increasing the pressure above the ball to move the sleeve axially downward.

18. The apparatus of claim 17, wherein the housing further comprises protrusions in the housing which are positioned such that each protrusion corresponds to either an open port or closed port position.

19. The apparatus of claim 18, wherein the sleeve further comprises a plurality of latching fingers that engage each protrusion to halt the downward motion of the sleeve.

20. The apparatus of claim 19, further comprising a spring washer and a supporting sleeve for the spring washer to resist the pressure applied to the sleeve via the ball and seat.

21. The apparatus of claim 20, further comprising a ball which is dropped into the seat to plug the seat and means for applying a predetermined pressure to the ball and seat to move the sleeve against the pressure of said spring washer and release the latching fingers from the housing ring to permit the sleeve to drop to next latching ring level.

22. The apparatus of claim 21, further comprising means for applying a predetermined pressure to the ball to expand the seat to allow the ball to pass through the seat and out of the housing.

23. The apparatus of claim 17, further comprising chevron seals placed above and below the housing flow holes on the inside of the housing.

24. The apparatus of claim 17, further comprising a dart directing sleeve arranged in the housing for aligning a dart with the seat as the dart passes through the drill string and into the housing, said dart directing sleeve having an inner wall smaller and smoother in diameter than the drill string, but larger in diameter than a dart being passed from the drill string and into the seat.

25. Apparatus for use in reducing surge pressure while running a tubular member in a borehole containing drilling fluid, which comprises:

a housing having a top end and having a bottom end for connection to a casing hanger, said housing having a set of housing flow ports formed therein;

a pipe connected to the top end of the housing for suspending the housing and tubular member and for providing a communication conduit between a drilling rig and the borehole;

a valving sleeve within the housing, which valving sleeve has a set of sleeve flow ports formed therein, the valving sleeve being initially positioned in the housing such that an open port condition exists;

a first protrusion and second protrusion that are formed in the housing at axially spaced locations;

a threaded sleeve which is attached to the top of the valving sleeve;

a plurality of latching fingers having first and second ends, the first ends of said latching fingers being attached to the threaded sleeve and the second ends of said latching fingers being machined to engage the first protrusion in the housing;

spring washers which are supported by the threaded sleeve; and a camming sleeve including a yieldable ball seat, which camming sleeve is supported by the spring washers and movable from a first axial position to a second axial position, where the camming sleeve in said first axial position contacts the second ends of the latching fingers to force them into engagement with the first protrusion in the housing and where the movement of the camming sleeve to the second axial position releases the latching fingers from engagement with the first protrusion to permit the valving sleeve to move to a closed port position.

26. The apparatus of claim 25, wherein the latching fingers engage the second protrusion in the closed port position.

27. A method for reducing surge pressure while running in a tubular member in a maintaining drilling fluid, comprising:

connecting a surge reduction device between the drill string and the casing liner, the surge on device having a plurality of alternating open port and closed port positions and having an sleeve that can be moved downwardly from one port position to the next, each open port position providing an upward path for drilling fluid to flow from the borehole into the tubular member, from the tubular member to the surge reduction device, and from the surge reduction device into an annular space between the drill string and the borehole and each closed port position providing a downward path for drilling fluid to flow from a drilling rig to the drill string, from the drill string to the surge reduction device, from the surge reduction device to the tubular member, and from the tubular member into the borehole;

lowering the tubular member into the wellbore with the surge reduction device in the first open port position;

moving the sleeve of the surge reduction device downward from the first open port position to the first closed port position;

moving the sleeve of the surge reduction device downward from the first closed port position to the second open port position; and moving the sleeve of the surge reduction device downward from the second open port position to the second closed port position.

* * * * *